US007476059B1

(12) United States Patent
Holland

(10) Patent No.: US 7,476,059 B1
(45) Date of Patent: Jan. 13, 2009

(54) EROSION CONTROL AND STABILIZATION BLANKET STAPLING APPARATUS

(76) Inventor: Gregory Paul Holland, 6504 3rd St. North, Moorhead, MN (US) 56560

( * ) Notice: Subject to any disclaimer, the term of this patent is extended or adjusted under 35 U.S.C. 154(b) by 128 days.

(21) Appl. No.: 11/602,090

(22) Filed: Nov. 20, 2006

(51) Int. Cl.
*E02D 17/20* (2006.01)

(52) U.S. Cl. ..... 405/302.7

(58) Field of Classification Search ..... 405/302.6, 405/302.7, 15
See application file for complete search history.

(56) References Cited

U.S. PATENT DOCUMENTS

| | | | | |
|---|---|---|---|---|
| 4,377,919 | A | 3/1983 | Gams | 47/1 |
| 4,605,149 | A * | 8/1986 | Farrens et al. | 227/7 |
| 4,627,563 | A | 12/1986 | Meyer | 227/130 |
| 4,706,864 | A | 11/1987 | Jacobsen et al. | 227/109 |
| 4,826,066 | A | 5/1989 | Koester et al. | 227/120 |
| 5,025,969 | A | 6/1991 | Koester et al. | 227/120 |
| 5,525,012 | A | 6/1996 | Casimaty et al. | 405/258 |
| 6,171,022 | B1 | 1/2001 | Decker | 405/16 |
| 6,585,456 | B2 | 7/2003 | Forse | 405/259.1 |
| 6,592,295 | B2 | 7/2003 | McPhillips | 405/129.9 |
| 6,663,324 | B2 | 12/2003 | Nordloh | 405/302.6 |
| 6,910,539 | B2 | 6/2005 | Carter | 173/1 |
| 7,351,016 | B1 * | 4/2008 | Nordloh | 405/302.6 |
| 2003/0198522 | A1 * | 10/2003 | Nordloh | 403/302.7 |
| 2004/0079539 | A1 * | 4/2004 | Schmidt | 172/439 |

* cited by examiner

*Primary Examiner*—John Kreck

(57) ABSTRACT

This erosion control or stabilization blanket stapling apparatus is designed to be used in conjunction with all terrain vehicles for the purpose of securing erosion control or stabilization blankets on sloping construction surfaces. A framework is mounted to the all terrain vehicle for holding the staplers in position while allowing them to follow uneven terrain. The vehicle is also equipped with compressed air to power the staplers.

17 Claims, 18 Drawing Sheets

FIG 6
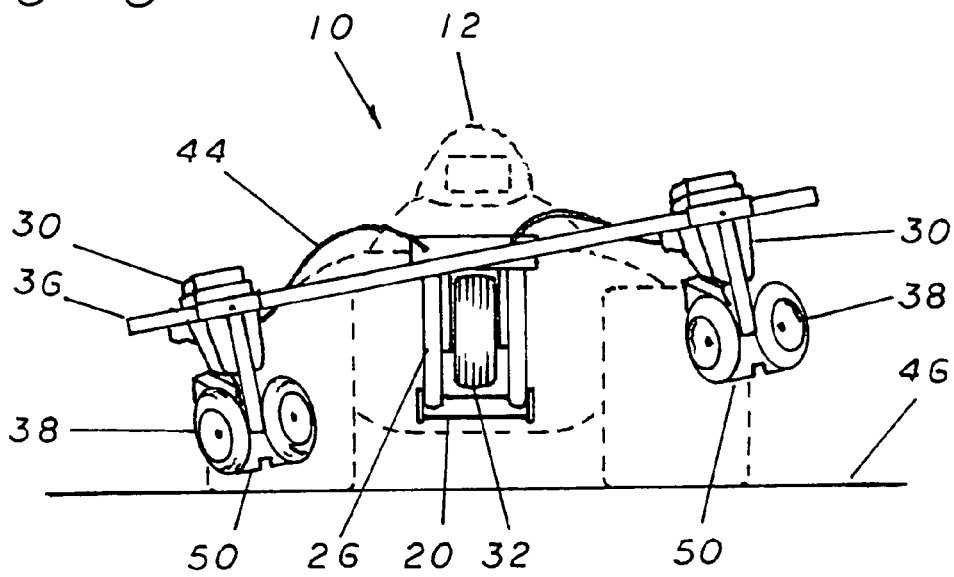
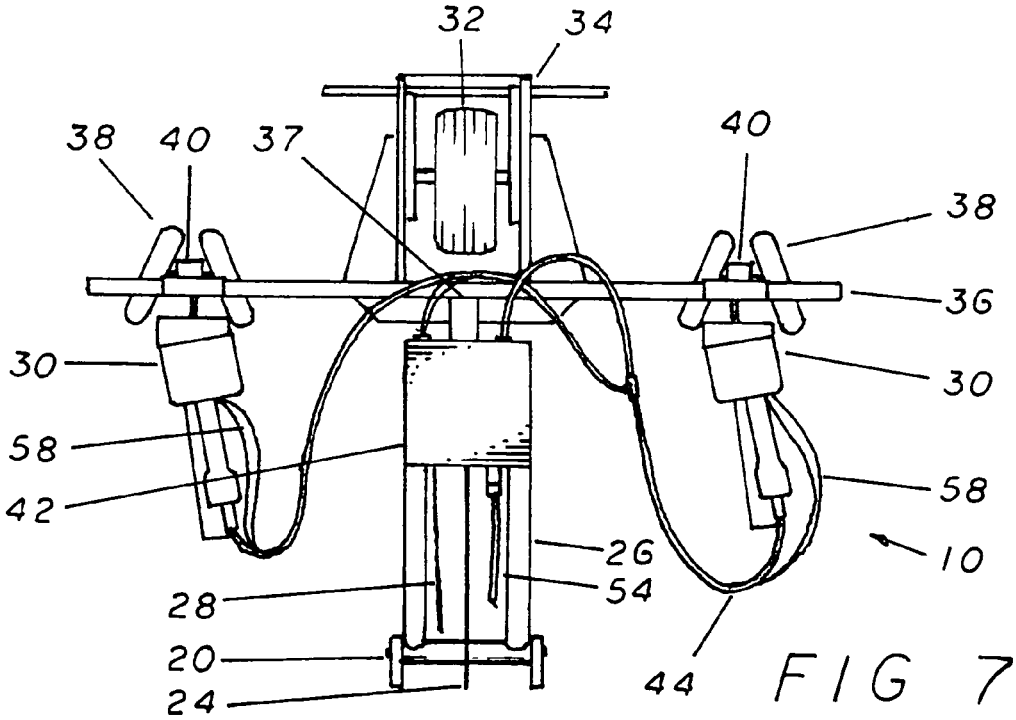
FIG 7

FIG 8
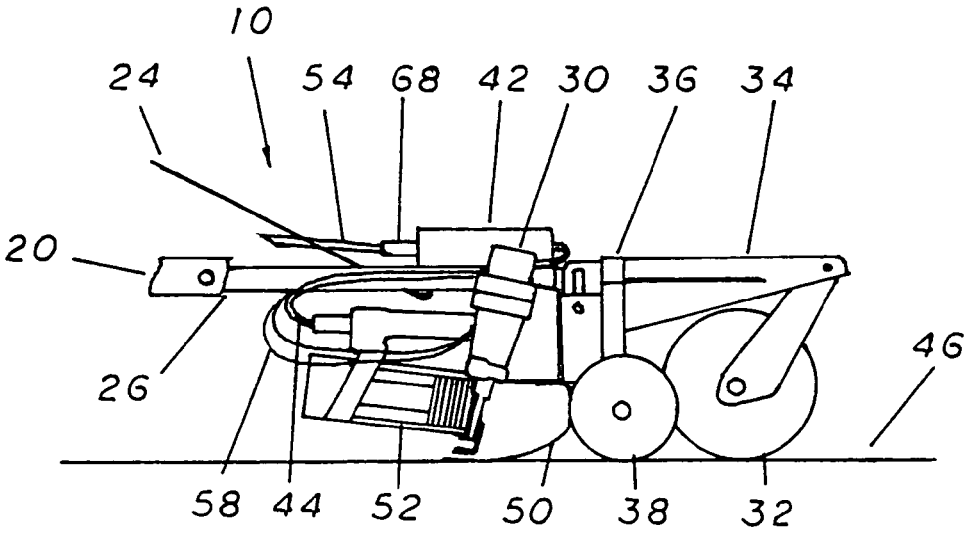
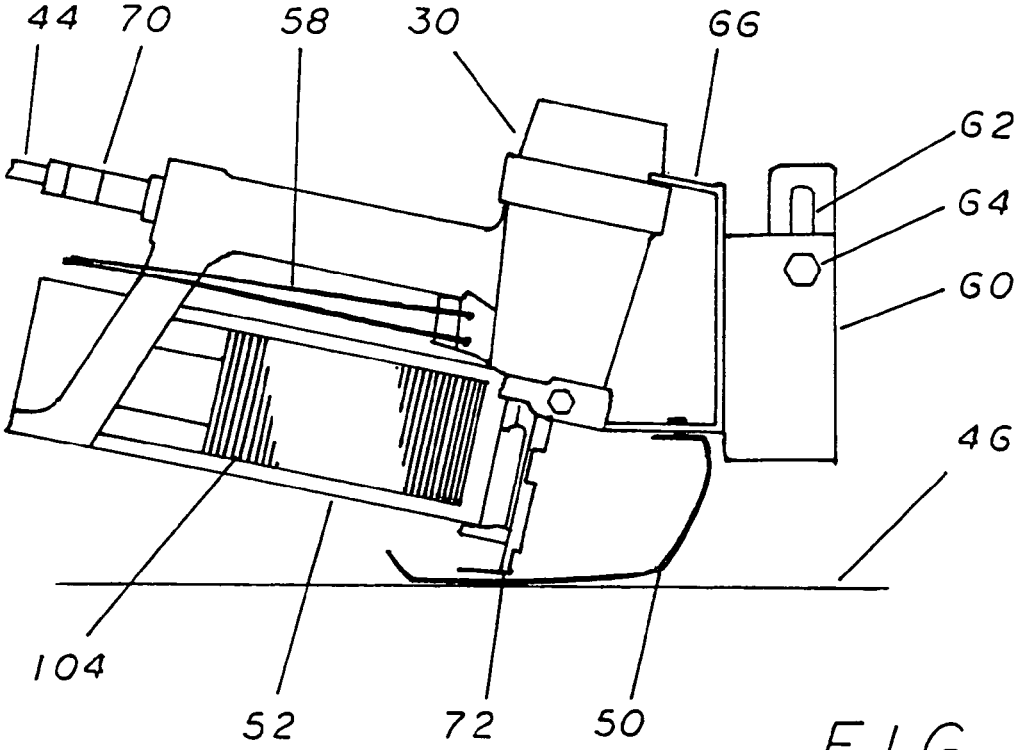
FIG 9

FIG 10
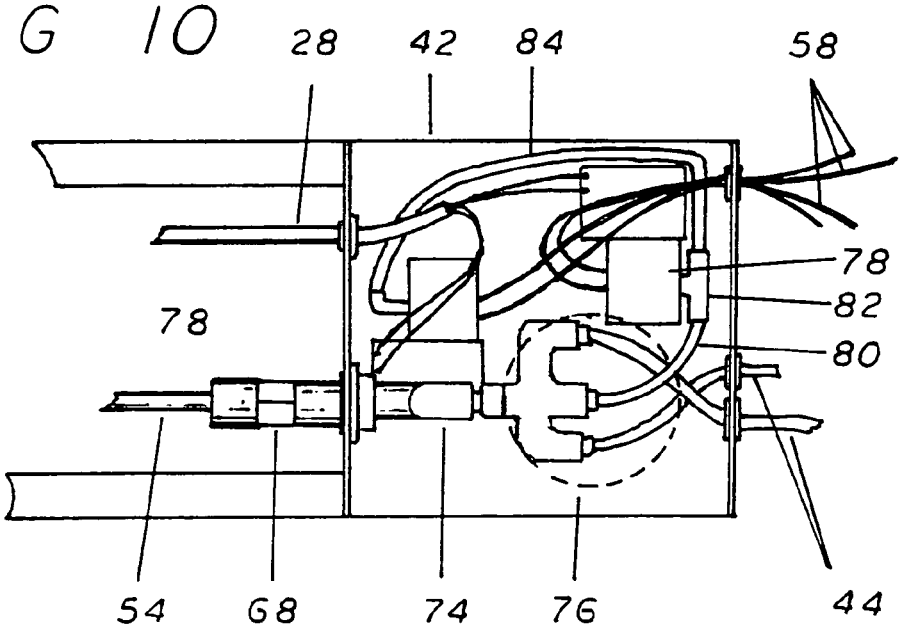
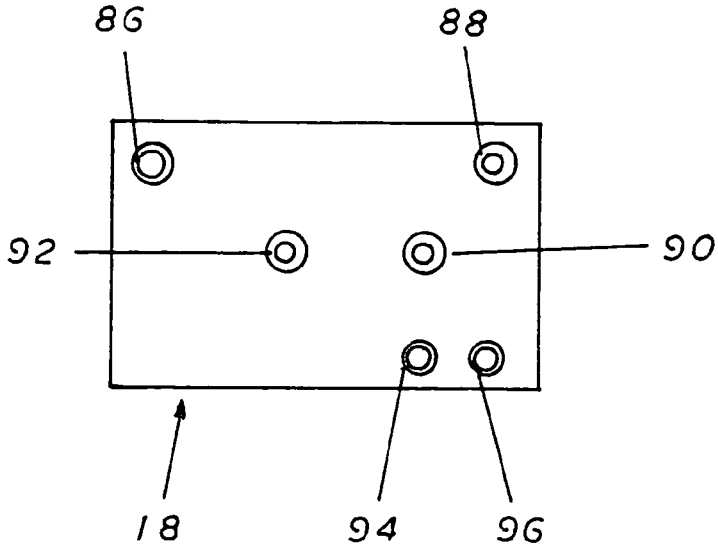
FIG 11

FIG 12
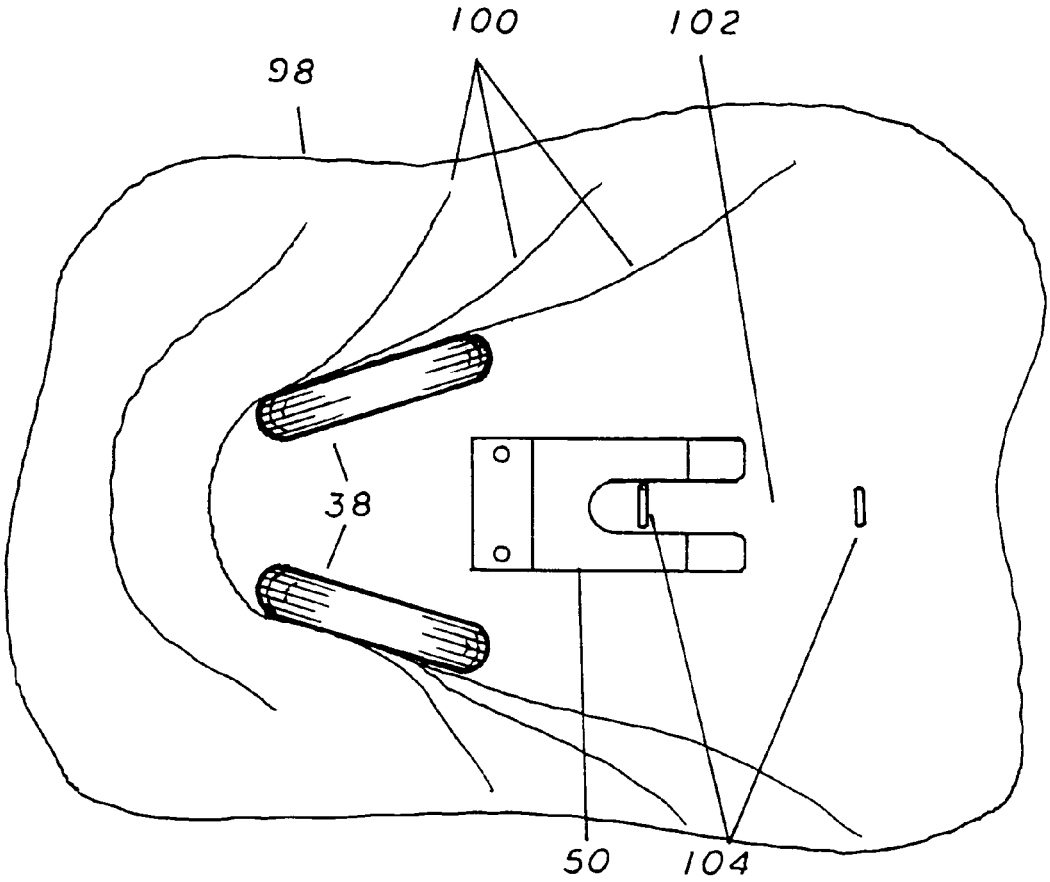
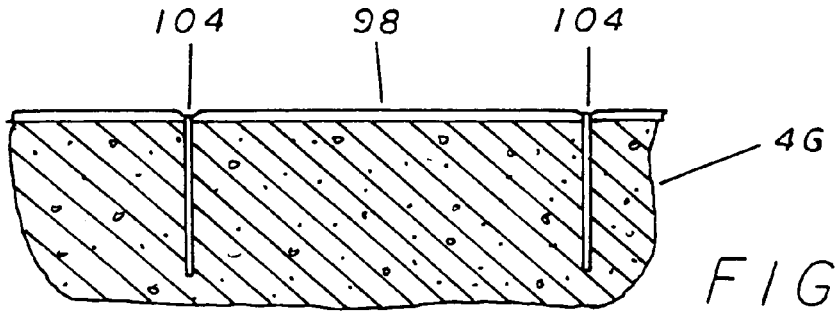
FIG 13

FIG 17
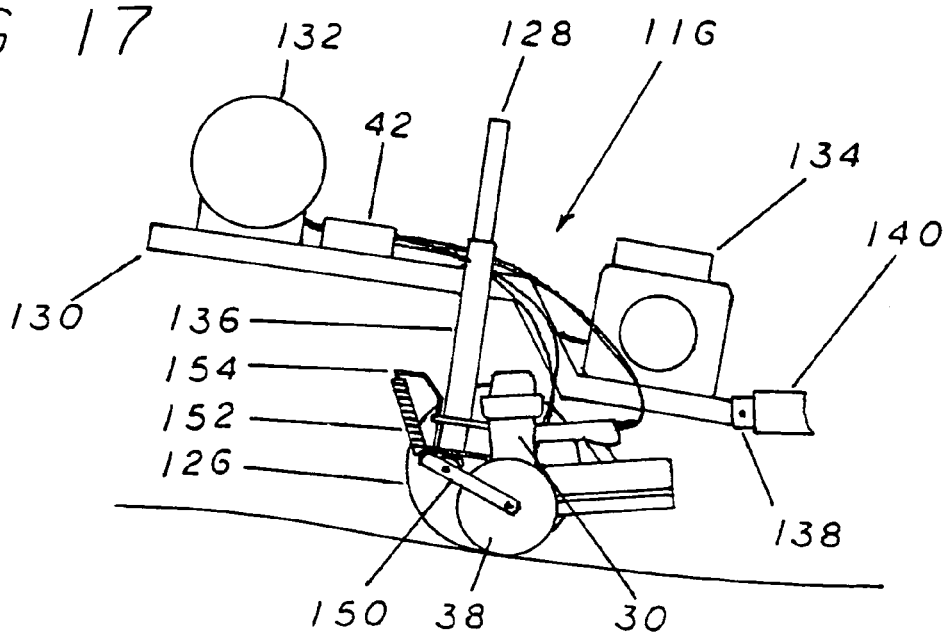
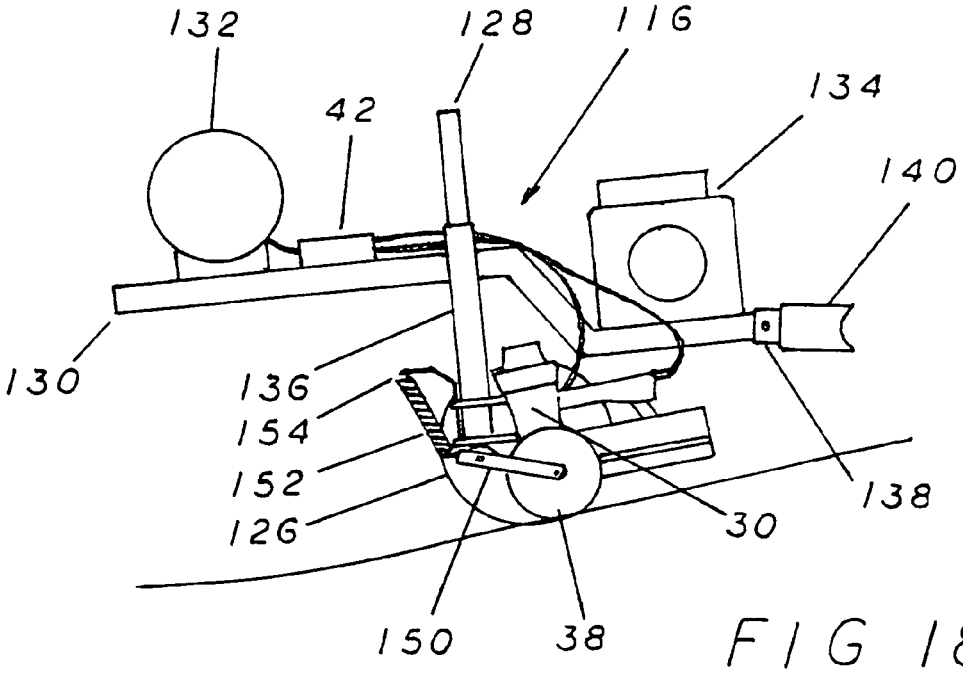
FIG 18

FIG 19
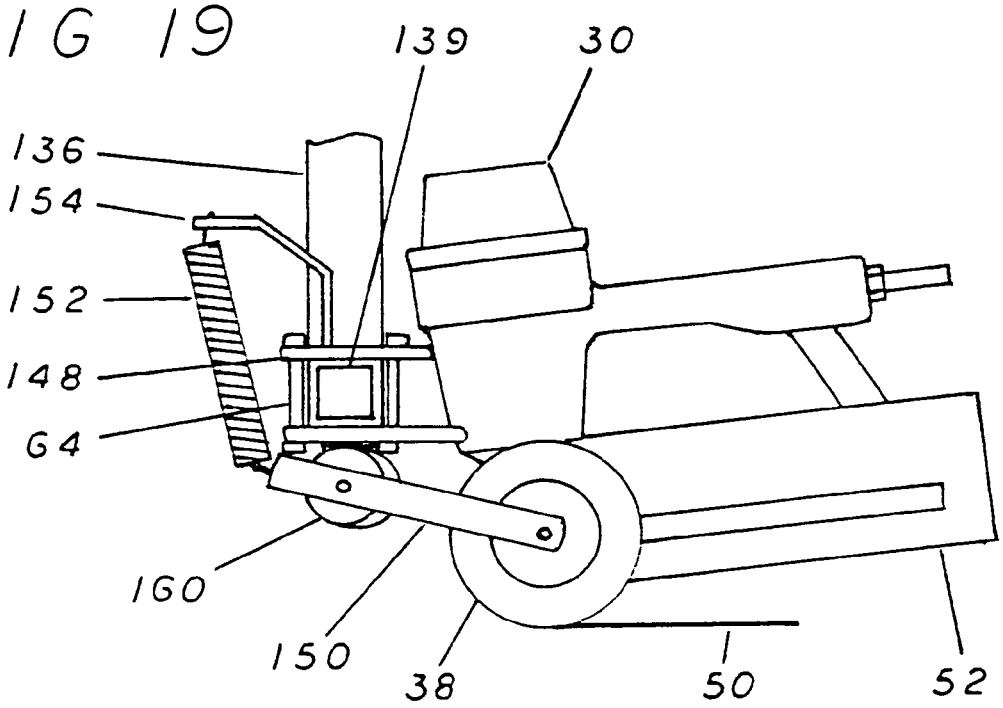
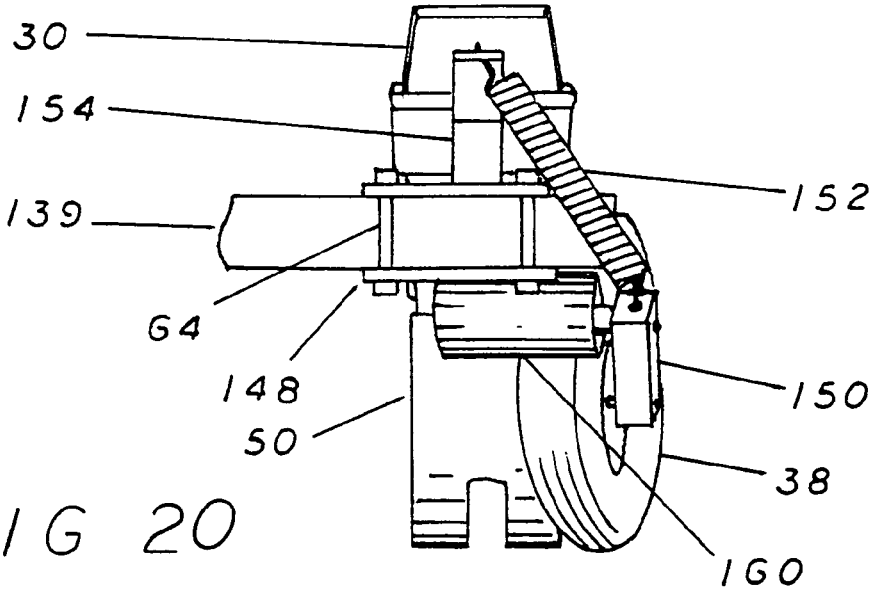
FIG 20

FIG 21
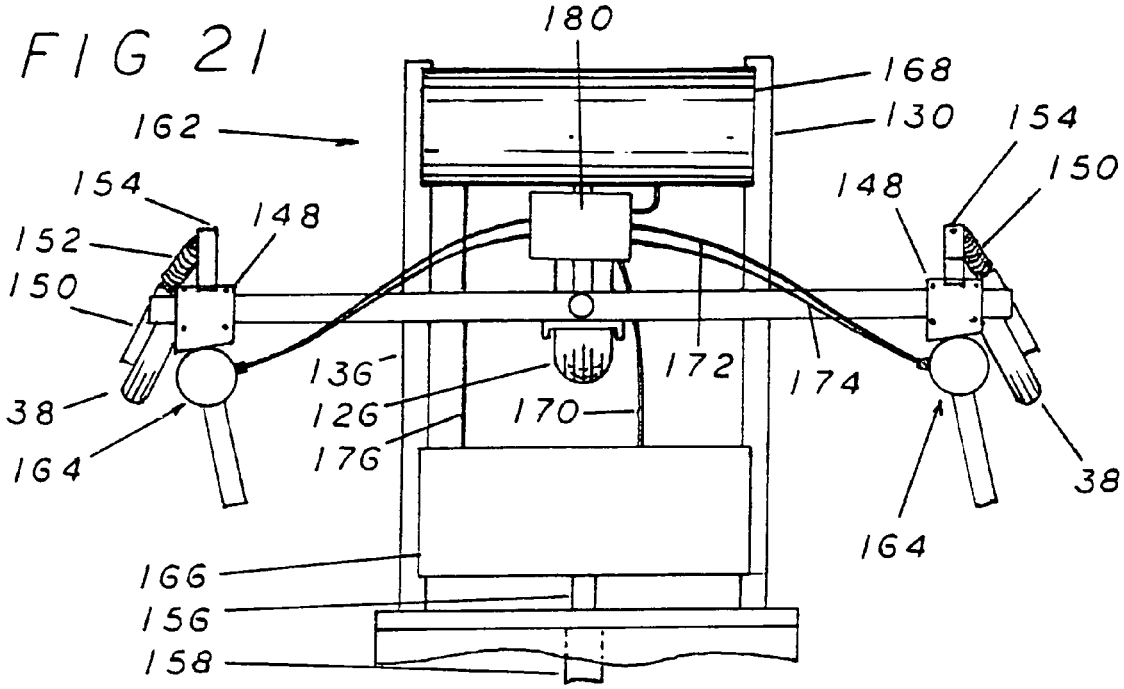
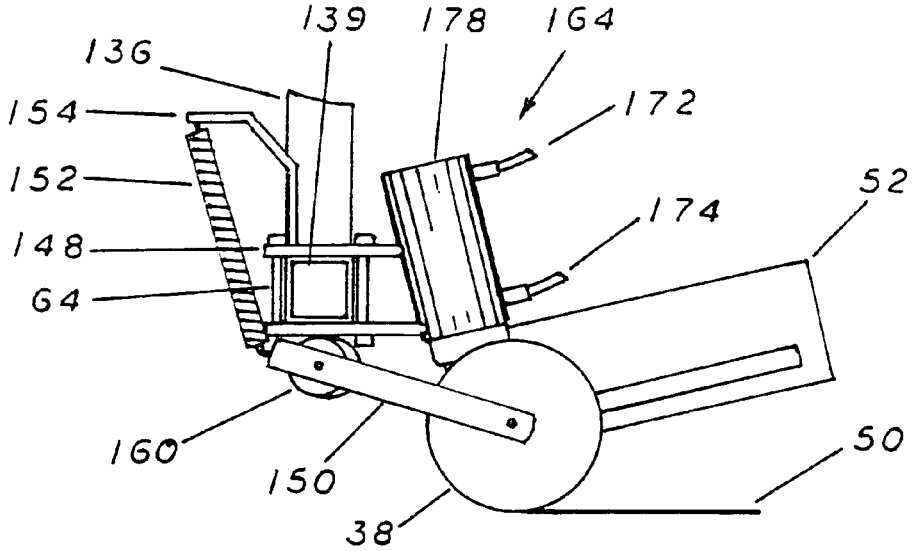
FIG 22

FIG 25
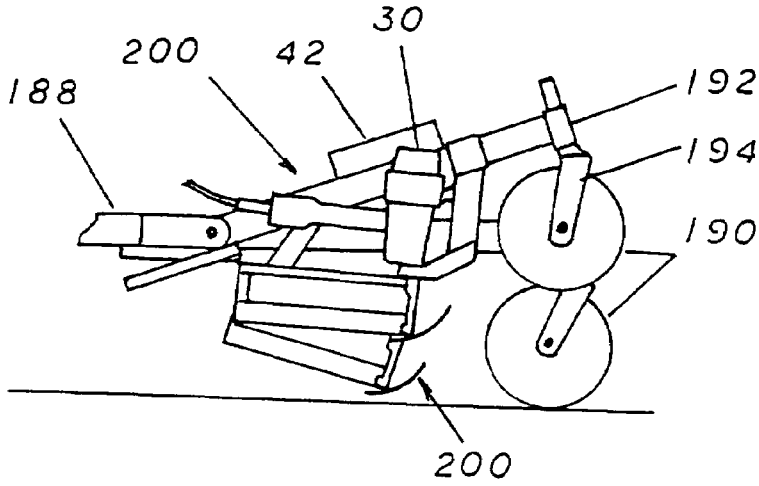
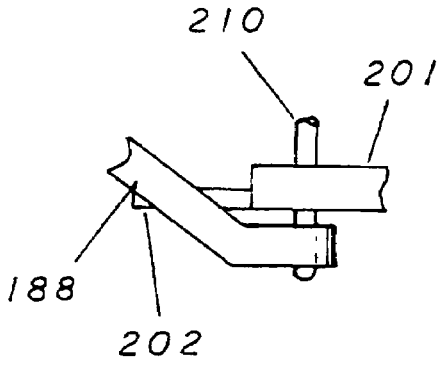
FIG 26
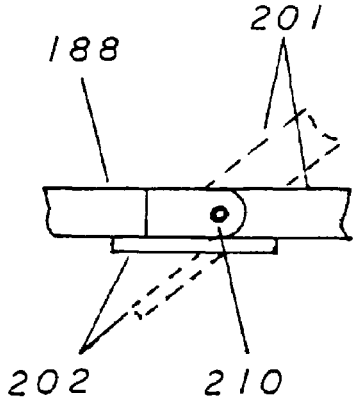
FIG 27

FIG 28
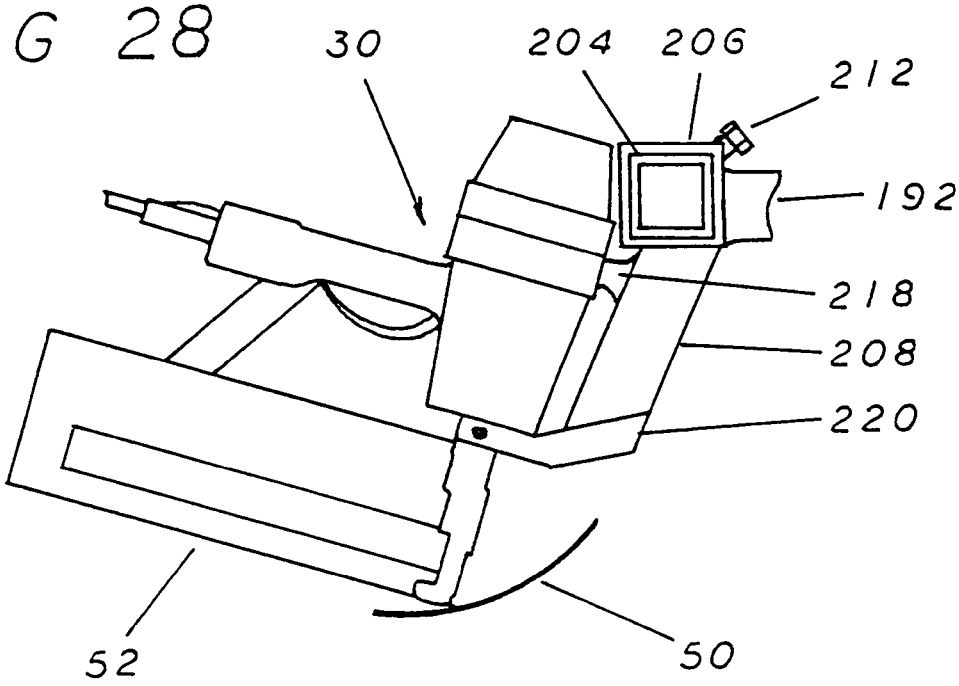
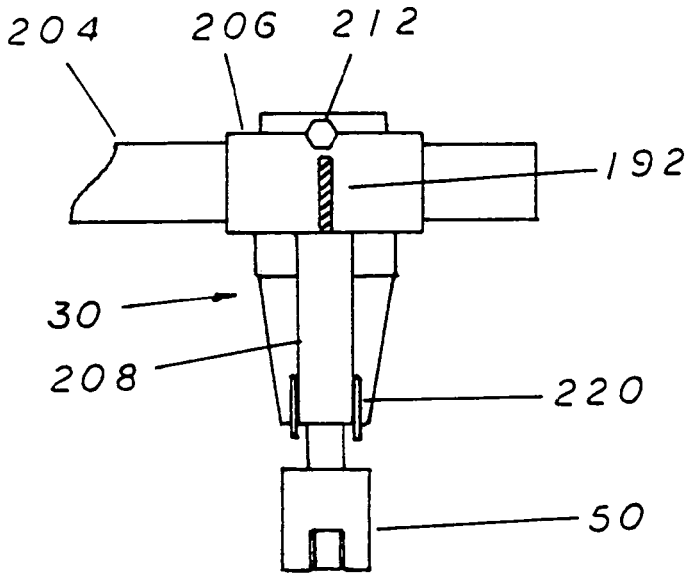
FIG 29

EROSION CONTROL AND STABILIZATION BLANKET STAPLING APPARATUS

BACKGROUND OF THE INVENTION

The present invention relates to an improvement in the methods used to stabilize surfaces that are subject to high degrees of erosion. More specifically, to an apparatus that has been specifically designed to be used in conjunction with erosion control or stabilization blankets and that operates to secure that blanket in place until a sufficient amount of grass or other ground cover can be placed or grown to stabilize the slope against erosion from rain, wind, and other forces of nature.

Sloped surfaces are subject to relatively high degrees of erosional forces. This is especially true in areas where the normal ground cover has been removed for construction purposes such as the building of highways, roads, buildings or other similar projects that require the alteration of the surface upon which they are built. Not only does the resulting erosion cause damage to the slope itself, it also results in the dumping of unwanted debris and sediment in downstream areas. Additionally, these slopes are very difficult areas to grow new vegetation on as the seeds or seedlings are often washed or blown away before they can take root to a sufficient degree.

Similarly, the preparation of the underlying ground in the construction of roads and highways often requires the use of geotextile fabric materials. In the construction of roads and highways there is often a need for the placement of a geotextile fabric between the underlying earth and the first layer of coarse aggregate that is commonly used for a roadbed or runway bed. The use of this material operates to distribute the downward forces of the roadway and the traffic it carries in a more lateral fashion and thus, over a wider area. This method of construction results in a stronger structure that lasts longer and requires less maintenance over its lifetime.

These problems have led to the development of erosion control or stabilization blankets and geotextile fabric. These blankets or fabric come in a variety of configurations and types but are generally elongated rectangular sheets. These elongated rectangles are then commonly rolled up into easily transportable cylinders which are then deployed in a side by side or end to end manner at the work site. Additionally, some of the erosion control blankets are impregnated with grass seed which will sprout on site thereby forming the desired ground cover.

A long-standing problem associated with the use of the erosion control and stabilization blankets is that they are also subject to the forces of nature making them susceptible to many of the same wind and rain problems. In order to avoid this it has become common practice to anchor the erosion control and stabilization blankets to the earth that it is covering. This anchoring is accomplished by a number of means including a plurality of staples, spikes, nails, and even specially designed machines that drive portions of the erosion control and stabilization blanket into the ground. While all of these methods are effective in securing the erosion control and stabilization blanket, they each suffer from a number of limitations.

The simplest and most common method of securing the erosion control or stabilization blankets is the manual insertion of staples, spikes, or nails through it and into the underlying ground. The problem with this approach is that it is very labor intensive and requires that a relatively large number of workers follow along after the deployment of the erosion control or stabilization blankets and drive the securement apparatuses into the ground. Additionally, this also requires that these workers either kneel or bend over to complete the process. This kind of labor is not only very time consuming but also commonly results in repetitive stress injuries such as knee and back problems. These circumstances result in an approach that is less than desirable.

Another approach of securing a deployed erosion control or stabilization blanket is the use of powered apparatuses that drive the securement device into the ground. These devices are typically operated by a single worker and are configured in such a manner so that the worker may remain upright while performing the operation. While this method is an improvement over that previously described, it also suffers from limitations. Primarily, this approach still requires a relatively large number of workers to complete a project. These apparatuses are capable of deploying one securement apparatus at a time and at a speed that is limited by the worker's pace. Additionally, as the erosion control or stabilization blankets are commonly deployed on high angle slopes, it can be difficult if not dangerous for the workers to be forced to move around on them.

Finally, the other method of securing erosion control or stabilization blankets is the use of specially designed equipment that both deploy and secure the blanket in one process. While the effectiveness of these systems is questionable at best, they suffer from even more problematic limitations. The first of these is that they are very expensive and often require that the operator replace existing equipment. This limits their actual use as many of the contractors engaged in these operations are either unwilling or incapable of absorbing the added expenses associated with their use. Additionally, the construction and operation of these apparatuses are complex; resulting in a situation which further limits their usefulness as it requires a further investment in training and increases the potential for lost revenues due to down time of the equipment.

Therefore, from the foregoing discussion it can be seen that it would be desirable to provide a mechanism of securing erosion control and stabilization blankets in a manner that dramatically reduces the required amount of labor hours. Additionally, it can be seen that it would be desirable to provide such a mechanism that is cost effective and which is capable of effectively operating on the severe sloping ground that is commonly associated with the use of erosion control and stabilization blankets.

SUMMARY OF THE INVENTION

It is the primary objective of the present invention to provide an erosion control and stabilization blanket stapling apparatus that is specifically designed to secure these blankets to an earthen surface thereby providing the desired stabilizing effect or allowing vegetative ground cover to take root and develop to the point where it is capable of stabilizing the surface and controlling erosional activity.

It is an additional objective of the present invention to provide such an apparatus which is capable of being employed in conjunction with a variety of different vehicles making it a more versatile tool for the completion of the intended purpose of securing erosion control and stabilization blankets.

It is a further objective of the present invention to provide such an apparatus that is capable of being operated by a single worker and which completes the necessary procedures in an efficient and cost-effective manner.

It is a still further objective of the present invention to employ such an apparatus that is capable of being effectively operated on the severely angled slopes that are commonly found in construction areas that require the use of erosion control or stabilization blankets.

These objectives are accomplished by the use of an erosion control and stabilization blanket stapling apparatus which is made up of multiple staple guns mounted on a central frame. These staple guns are of a special design allowing for the application of staples of a sufficient length so as to adequately secure the erosion control or stabilization blanket to the surface of the covered ground. Additionally, these staple guns are most commonly (but not necessarily always) controlled and operated by compressed air. The frame of the present invention is constructed in a manner so that the placement of the staple guns in relation to one another accomplishes the desired function in the most effective manner possible.

The present invention is designed to be used in conjunction with a self-propelled vehicle. In the case of the illustrated embodiment this vehicle is an all terrain vehicle commonly built and sold by many different companies throughout the world. It is important to note, however, that the use of the present invention is not necessarily limited to this type of vehicle and the discussion and illustrations referring to these vehicles are for illustrative purposes only.

These vehicles also provide for the attachment of an auxiliary air compressor unit. The auxiliary air compressor unit operates independently from the vehicle and is employed to provide the compressed air required for the operation of the present invention.

The present invention is secured to the front end of the vehicle in a manner so that it is capable of pivotal manipulation in the vertical axis. Additionally, the present invention contains a design feature that allows its forward end to articulate in a rotational manner. These design features of the present invention are critical to its operation as they allow it to be deployed on surfaces that are irregular in both their vertical and side to side orientations with respect to the direction of travel of the vehicle.

The vertical orientation of the present invention is controlled through the use of a winch located on the most forward surface of the vehicle. The winch is connected to the present invention through the winch cable. The winch cable extends from the winch to the point of attachment located on the frame of the present invention. This method of construction allows the operation of the winch to both lower and raise the present invention in a vertical manner in relation to the surface of the ground. Additionally, the nature of the pivotal attachment of the present invention is capable of passively adjusting to vertical variations in the ground as the vehicle travels over the slope.

The two primary structural components of the present invention are the frame and the cross member. The frame serves to pivotally attach (in the vertical plane) the invention to the vehicle and to properly position the cross member. The cross member is then rotationally attached to the outer end of the frame at its midpoint and is perpendicularly oriented to it. The cross member provides for the point of fixed attachment of the staple guns which, in the instant configuration, are positioned at its outside ends.

The central portion of the cross member also provides for the point of fixed attachment of the odometer wheel. The odometer wheel is mounted by means of the odometer wheel frame which extends forward from the cross member. The odometer wheel functions to monitor the distance that the vehicle and the attached present invention have traveled. The information generated by this is employed to control the spacing of the staples being utilized to secure the erosion control or stabilization blanket. Moreover, the spacing of the staples can be adjusted through the control panel located on the steering mechanism of the vehicle depending on the terrain being covered and the data received from the odometer wheel. Additionally, a further embodiment of the present invention has been contemplated in which the monitoring function of the odometer wheel is accomplished by other existing components of the invention.

Finally, the points of attachment for the staple guns also provide for the points of attachment for the flattening wheels. The flattening wheels are mounted in a position so that as the present invention travels forward, they engage and flatten the erosion control and stabilization blankets just prior to the application of the staple. The flattening wheels are configured in pairs that are mounted on either side of the staple guns. Additionally, the leading edges of the flattening wheels are closer together than the trailing edges. The result of this configuration is that as the pair of flattening wheels engage and pass over the erosion control or stabilization blanket, that portion of it through which a securing staple is to be passed is stretched and tightened to remove any wrinkles or other irregularities. Thus, the use of the flattening wheels ensures that the erosion control or stabilization blanket is in the optimal orientation prior to the insertion of the staples. This provides the highest degree of contact between the staple, erosion control or stabilization blanket, and the ground thereby ensuring that the specific blanket is secure as possible in the desired position.

An additional embodiment of the present invention is contemplated in which the system control panel has been replaced with an electronic system control panel. The use of the electronic system control panel allows for a greater degree of control during the staple application process thereby further enhancing the described desirable characteristics of the present invention.

A further embodiment of the present invention has been contemplated in which a mower mounted erosion control stapler apparatus is constructed in a manner that allows for its use with common riding zero turn radius riding mowers. As opposed to tractor style riding mowers, these riding zero turn radius mowers are constructed with a frame that is relatively low to the ground. As a result of this, the frame of this embodiment of the present invention must be designed to accommodate this low frame while providing a means for both its support and for the placement of the staplers in the necessary position.

This embodiment of the present invention employs two parallel rails to form the apparatus step up frame. From their point of pivotal attachment to the frame of the riding zero turn radius riding mower, the parallel rails of the apparatus step up frame extend forward in a horizontal (with reference to their neutral position and the mower) manner. This initial horizontal portion provides for the placement of an air compressor. The air compressor is typically powered by a power take off (PTO) shaft located on the most forward end of the riding zero turn radius riding mower, however, a self-contained unit would work in this application equally as well.

Just forward of the position of the air compressor, the parallel rails of the apparatus step up frame angle upward in a diagonal manner for a short distance. At the end of this diagonal run, the parallel rails then again return to their horizontal orientation and extend forward to their terminus. This horizontal section of the parallel rails provides a plurality of purposes in relation to the operation of this embodiment of the present invention. The first of these is to allow for the attachment of the air tank. The air tank stores a volume of compressed air for use in the staplers. The air tank is typically positioned on the most forward ends of the parallel rails.

Additionally, this horizontal portion of the parallel rails also allows for the attachment of the control box which distributes the compressed air as needed during the operation of the present invention.

Most importantly, this horizontal section of the parallel rails of the apparatus step up frame allow for the elevated—in relation to the frame of the mower—attachment of the stapler drop-down frame. The stapler drop-down frame is attached to the parallel rails in a perpendicular manner just forward of the diagonal section. Additionally, the stapler step-down frame is configured with a U-shaped central U-shaped portion. The inner and central portion of this U-shape provides the point of attachment for the stapler drop-down frame to the parallel rails. Additionally, the outer ends of the stapler drop-down frame return to the horizontal section. These horizontal sections then provide for the attachment of the staplers in positions so that they may easily engage the surface over this embodiment of the present invention.

The final unique feature of this embodiment of the present invention is the centrally positioned apparatus support wheel. The apparatus support wheel is attached to the central portion of the drop-down stapler frame by means of the support wheel pin. The apparatus support wheel is of the castor design allowing it to easily track with the direction of the riding zero turn radius riding mower while providing the necessary support to this embodiment of the present invention. Additionally, when operating in conjunction with the pivotal attachment of the parallel rails of the apparatus step up frame, the apparatus support wheel allows the staplers to follow the contours of hills and depressions providing a means by which this embodiment of the present invention can be effectively employed on uneven terrain. In all other aspects of its operation, this embodiment of the present invention functions in the same manner as described above for the previous embodiment.

A still further embodiment of the present invention has been contemplated in which the pneumatically operated staplers are replaced by hydraulic staplers. The resulting hydraulic stapler apparatus varies only from the previously described embodiment of the present invention in the use of the hydraulic staplers. As a result, any of these embodiments are capable of being adapted to use with the hydraulic staplers, however, for the sake of simplicity the provided FIGURES illustrate their use only in conjunction with the latter embodiment.

This embodiment of the present invention requires a number of modifications relative to the previous embodiments. The first of these is the use of the hydraulic staplers. The hydraulic staplers operate and attach in the same manner as the pneumatic staplers except that they employ hydraulic cylinders to fire the staplers. The hydraulic pressure that is necessary for their operation is supplied through the use of an hydraulic pump that is mounted on the rearward portion of the parallel rails of the apparatus step up frame. In the illustrated case the hydraulic pump is powered by a connection to a riding mower's PTO, but a stand-alone unit would work equally as well. The hydraulic pump is supplied with hydraulic fluid by the fluid reservoir positioned at the front of the apparatus step up frame. The hydraulic fluid is directed to and from the hydraulic staplers through a hydraulic pressure control valve and stapler pressure and return lines. In all other aspects of its operation, this embodiment of the present invention functions in the same manner as described above for the previous embodiment.

Finally, a yet further embodiment of the present invention has been contemplated in which the frame of the previous embodiments are replaced with a frame that is made up of two separately articulating frame members. The resulting embodiment is referred to as the independently articulating erosion control stapler apparatus.

This embodiment of the present invention is illustrated as used with a specific type of front drive mower. This type of mower is also a zero radius turn mower but differs in the methods employed to control its direction of travel. The relevance of this to the operation of this embodiment of the present invention is only in the method employed by this style of mower to suspend and control the mower deck. These functions are accomplished by the use of a pair of mower accessory mount arms that extend outward from the most forward end of the mower. These mower accessory mount arms may be lowered or raised by the operator as needed.

In general, this embodiment of the present invention positions each of two staplers on two independent pivot frames that are in turn pivotally attached to outer ends of the mower accessory mount arms. The manner of attachment accomplishes a plurality of purposes with respect to the operation of this embodiment of the present invention. One of these is to allow for its positioning at the front of the front drive mower so that its operation may be constantly monitored by the operator. Additionally, the mower accessory mount arm's ability to be raised and lowered allows the operator to raise this embodiment of the present invention off of the ground when not in use or when it is necessary to move it from one place to another. Finally, its positioning at the front end of the front drive mower functions in conjunction with the design of these style of mowers.

The pivotal attachment of the two independent pivot frames to the mower accessory mount arms is accomplished by the use of the frame pivot bar. The frame pivot bar spans the area between the distal end of the mower accessory mount arms. This provides for the pivotal points of attachment of the proximal ends of the independent pivot frames just inside the corresponding mower accessory mount arms. This method of attachment allows each of the independent pivot frames to rotate in a vertical plane around this point of attachment. This capability is central to the operation of this embodiment of the present invention in that it allows each of them to adjust to irregularities in the ground surface independently from each other. This design enhances the operation of the present invention especially in uneven terrain as it provides a method that ensures that each applied staple will have the maximum possible contact with the ground to which it is applied.

The independent pivot frames are made up of two primary components. The first of these is the pivot member that makes the necessary pivotal connection and forms the base of this embodiment of the present invention to which the rest of the components are attached. Near its point of pivotal attachment at its proximal end, the pivot members are also equipped with the frame pivot stops. The frame pivot stops are fixedly attached to the lower surface of each pivot member and extend beyond their proximal ends. The function of the frame pivot stops is to limit the downward travel of the independent pivot frames by engaging the lower surfaces of the mower accessory mount arms in the desired location.

The second component of the independent pivot frames is the stapler frame. The stapler frame is fixedly attached to the distal end of the pivot members in a perpendicular manner. Additionally, this attachment is accomplished so that the majority of the stapler frames extend outward with respect to the center line of this embodiment of the present invention. This configuration ensures that the two staplers can be located in the optimal position with respect to each other.

The attachment of the staplers to the stapler frames is accomplished by the use of the stapler mount collars. The stapler mount collars are made of relatively short sections of square tubing having an internal dimension that is large enough to fit over the stapler frames. This method of attachment allows the position of the staplers to be varied with respect to the length of the stapler frames to conform with a variety of possible requirements.

The attachment of the staplers to the stapler mount collar is facilitated by the use of the stapler mount bars. The stapler mount bars are fixedly attached to the lower surfaces of the stapler mount collars and extend downward therefrom. The staplers are then attached to this at their upper ends by the upper stapler connection and at their lower end by the lower stapler mount brackets. These components serve to position the staplers in the desired location to perform the function that is central to the present invention.

The stapler mount collars also provide for the point of attachment for the castor wheel frames. The castor wheel frames extend forward from the most forward surface of the stapler mount collar and serve to allow for the attachment of the front support castor wheels. The front support castor wheels support the forward end of this embodiment of the present invention and are mounted within castor wheel brackets that allow them to pivot around their vertical axis attachment to the castor wheel frames. The front support castor wheels replace the flattening wheels of the previous embodiments but it must be noted that the flattening wheels could also replace the front support castor wheels employed in this embodiment of the present invention.

Finally, one of the front support castor wheels can also be constructed to perform the odometer operations that are used in the previous embodiment of the present invention. The electrical connection required by this is accomplished by an odometer wire that runs from the applicable front castor wheel to the control box. The nature of castor wheels requires that this odometer wire be fitted with an odometer wire swivel connector ensuring that the odometer wire will not become tangled no matter how many times the castor wheel spins around it vertical axis during the operation of the present invention.

For a better understanding of the present invention reference should be made to the drawings and the description in which there are illustrated and described preferred embodiments of the present invention.

DESCRIPTION OF THE DRAWINGS

FIG. 6 is a front elevation view of the present invention of FIG. 4 illustrating its ability to articulate in a rotational manner with respect to the surface of the ground.

FIG. 7 is a top elevation view of the present invention illustrating the orientation of its major components with respect to one-another.

FIG. 8 is a side elevation view of the present invention of FIG. 7.

FIG. 9 is a side elevation view of a staple gun component of the present invention illustrating its general configuration, the manner of its attachment to the present invention, the mechanisms by which it is supplied power, and the manner in which it engages the erosion control and stabilization blankets.

FIG. 10 is a top elevation view of the system control panel component of the present invention illustrating the orientation of its contained components which control the operations of the invention.

FIG. 11 is a front elevation of the system control panel component of the present invention illustrating the positioning of the apparatus controls.

FIG. 12 is a representative diagram illustrating the operation of the flattening wheel components of the present invention.

FIG. 13 is a side elevation cross-sectional view of a portion of an erosion control or stabilization blanket and illustrating the manner in which the staples are employed to secure the erosion control or stabilization blanket to the ground.

FIG. 17 is a side elevation view of the mower mounted erosion control blanket stapling apparatus illustrating its major components and the manner that they cope with elevation changes in the ground over which it is traveling.

FIG. 18 is a side elevation view of the mower mounted erosion control blanket stapling apparatus of FIG. 17.

FIG. 19 is a side elevation view of the staple component of the mower mounted erosion control blanket stapling apparatus illustrating its components and the manner in which it is attached to the frame.

FIG. 20 is a front elevation view of the staple component of the mower mounted erosion control blanket stapling apparatus of FIG. 19.

FIG. 21 is a top elevation view of a further embodiment of the present invention that employs hydraulic staplers and the accompanying components necessary for their operation.

FIG. 22 is a side elevation view of the hydraulic stapler component of the hydraulic stapler apparatus of FIG. 21 that illustrates the general manner of construction of the hydraulic stapler.

FIG. 25 is a side elevation view of the independently articulating erosion control stapler apparatus illustrating the ability of the two independent pivot frames to obtain different pivotal orientations.

FIG. 26 is a top elevation view of the pivotal connection between an independent pivot frame and mower accessory mount arm and detailing the location and operation of the frame pivot stop and the stapler mount bar.

FIG. 27 is a side elevation view of the pivotal connection between an independent pivot frame and mower accessory of FIG. 26.

FIG. 28 is a side elevation view of the stapler component of this embodiment of the present invention illustrating the manner in which it is fixed to the stapler frame, FIG. 29 is a top elevation view of the stapler component of FIG. 28.

DESCRIPTION OF THE PREFERRED EMBODIMENT

Figure 1:
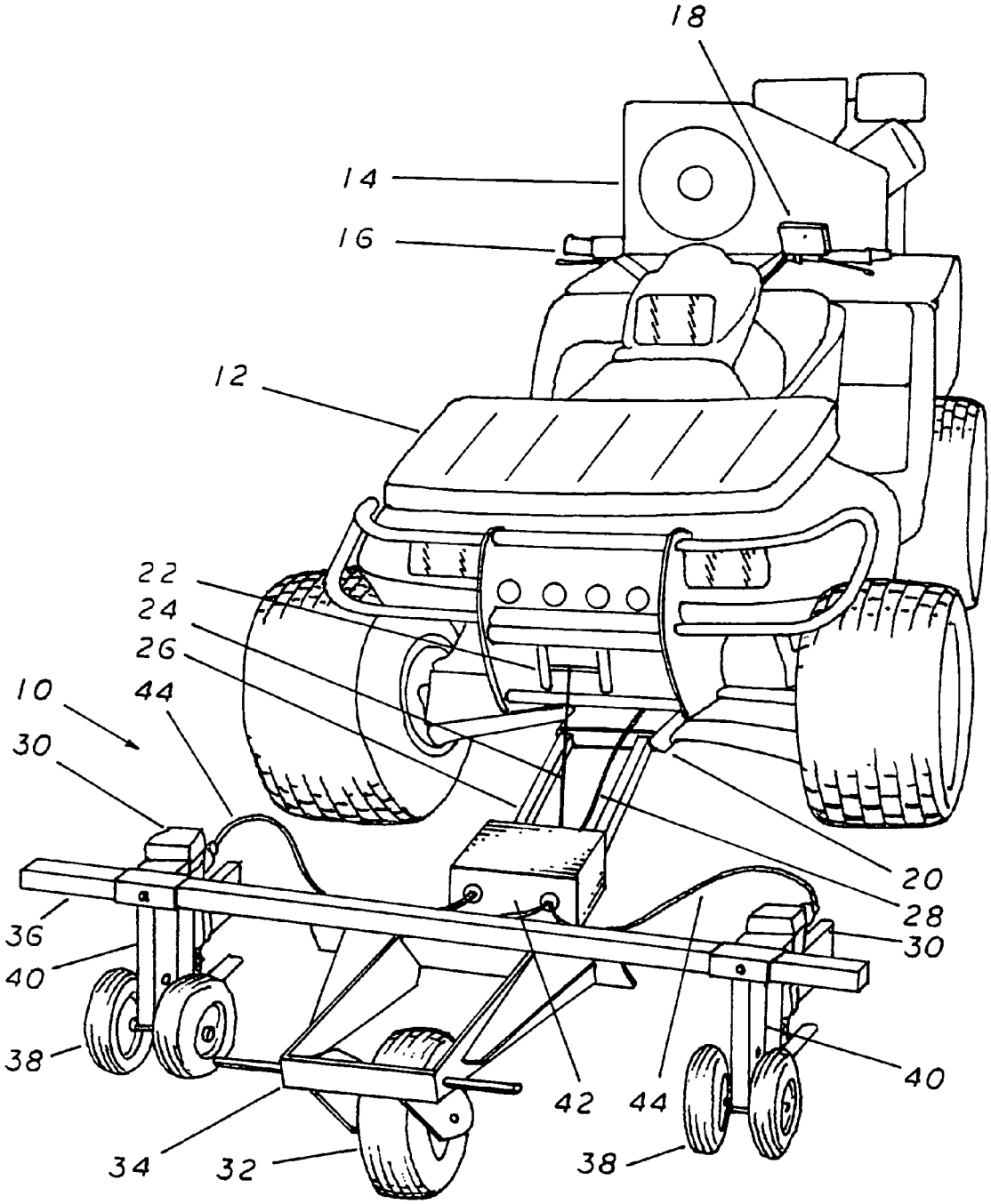
FIG. 1 is a perspective view of the present invention which illustrates the manner in which it is attached to a vehicle and showing the configuration of its major components and their relation to one another.
Figure 2:
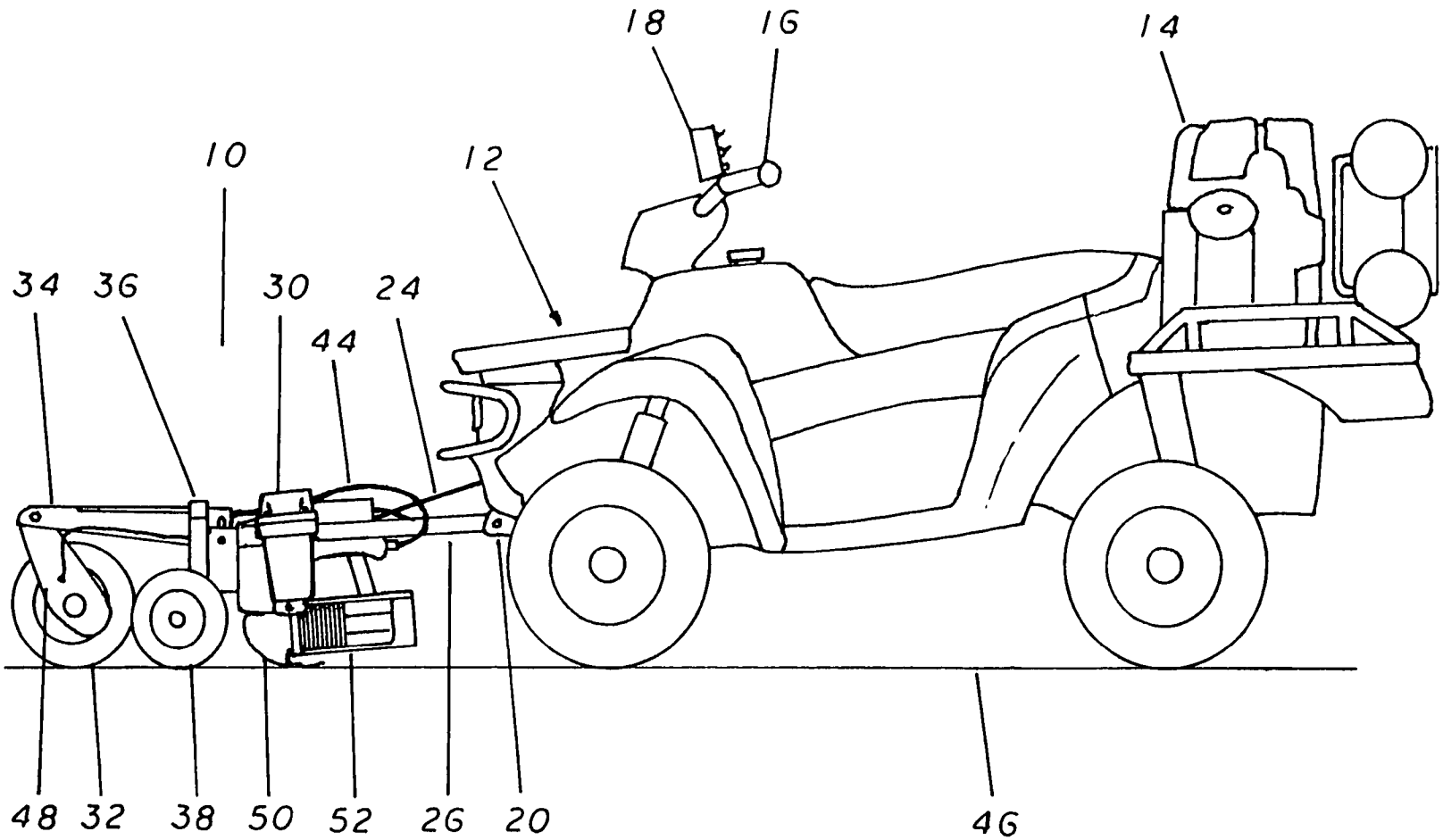
FIG. 2 is a side elevation view of the present invention of FIG. 1 further illustrating its position relative to the vehicle.
Figure 3:
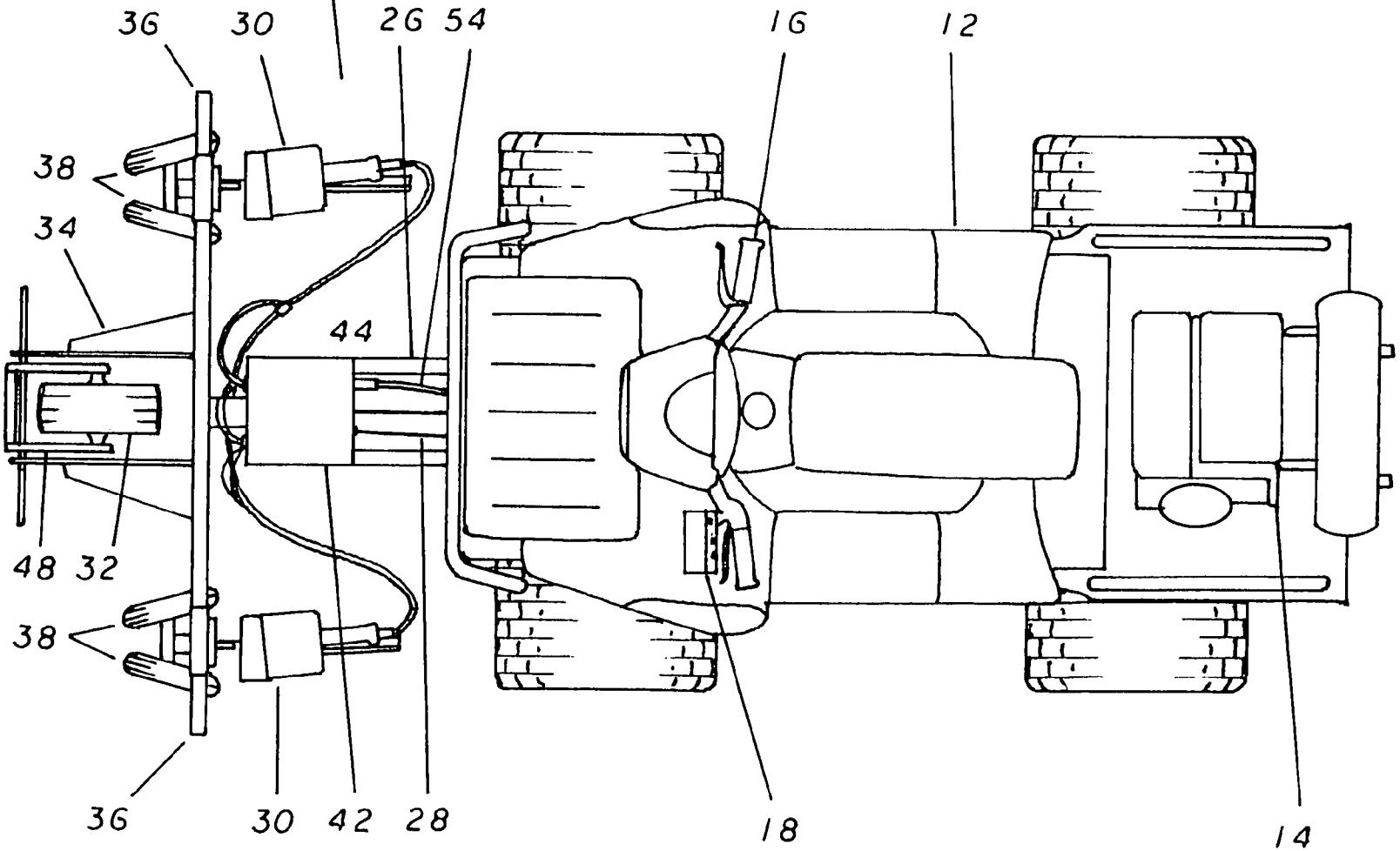
FIG. 3 is a top elevation view of the present invention of FIG. 1 further illustrating its position relative to the vehicle.

Referring now to the drawings, and more specifically to FIGS. 1, 2, and 3, the erosion control and stabilization blanket stapling apparatus 10 is made up of a central frame 26 which is pivotally mounted to the front end of a vehicle 12 by the use of an apparatus mount 20. The apparatus mount 20 provides a mechanism by which the present invention may be articulated in a vertical manner. This capability is important to the operation of the present invention and will be discussed in greater detail below.

The vehicle 12 as illustrated is an all terrain vehicle but the present invention is capable of being employed with any number of similar vehicles. These vehicles 12 are generally controlled by a steering mechanism 16 mounted forward of a seat in much the same manner as motorcycles. For the purposes of the present invention, the steering mechanism 16 also serves as the point of attachment for the system control panel 18. The system control panel 18 is the component of the present invention which the operator employs to control the various operations of the present invention.

The vehicle 12 also provides for the placement of the auxiliary air compressor unit 14. The auxiliary air compressor unit 14 is the component of the invention which supplies the power necessary to operate the staple guns 30 which, in this illustration, are pneumatically operated. The auxiliary air compressor unit 14 is typically made up of a small gasoline engine that drives an air compressor and operates independently from the vehicle 12. The resulting compressed air is then stored in a tank until it is diverted to the present invention when needed. Finally, the vehicle 12 is also equipped with a winch which is connected to the frame 26 of the present invention by the use of the winch cable 24.

The erosion control and stabilization blanket stapling apparatus 10 itself is made up of multiple staple guns 30 mounted on a cross member 36 which is in turn pivotally mounted on the frame 26. The frame 26 is pivotally mounted at its proximal end to the vehicle 12 by the use of the apparatus mount 20. From this point of connection, the two parallel members of the frame 26 extend forward to their point of terminus at the cross member 36. Additionally, the distal end of the frame 26 serves as the point of attachment for the control box 42.

The control box 42 contains many of the control mechanisms of the present invention including the pneumatic and electrical controls. The power to operate these systems is supplied from the vehicle 12 through the power feed 28 and the air feed line 54. The control box 42 and its associated systems will be discussed in greater detail below.

As previously stated, the primary function of the frame 26 and cross member 36 is to position the staple guns 30 in the desired locations. This is accomplished through a general T configuration with the frame 26 extending forward from the vehicle 12 to the point where it terminates at its pivotal attachment to the perpendicular cross member 36. The cross member 36 then extends outward in both directions providing for the placement of the staple guns 30.

The present invention is also equipped with a plurality of wheels which perform a variety of functions with respect to its operation. One of these is the odometer wheel 32 which is mounted in a position that is forward of the cross member 36 by the use of the odometer wheel frame 34 and the odometer wheel mount 48 which extends downward from the lower surface of the odometer wheel frame 34. This configuration places the odometer wheel 32 at the most forward position of the present invention allowing it to perform its intended function.

The odometer wheel frame's 34 attachment to the frame 26 is accomplished in a pivotal manner. This allows the odometer wheel 32 to articulate with respect to the body of the present invention as it travels over the surface of the ground 46. This is important to its operation as it provides a means by which the odometer wheel 32 can stay in contact with the surface in circumstances where variations in elevation are encountered. Additionally, one possible variation of the construction of the odometer wheel frame 34 provides for the use of an expansion spring (not shown) which spans the pivotal mount between the odometer wheel frame 34 and the frame 26 of the present invention. This spring serves to bias the odometer wheel frame 34 to a neutral position relative to the body of the present invention enhancing its overall performance.

The primary function of the odometer wheel 32 is to monitor the travel of the present invention and to provide the information gathered to its control components. This function is accomplished by the placement of a sensor on the odometer wheel 32 which measures its travel and transmits the resulting data back to the system control panel 18. This information is used then to control the frequency of the application of the staples 104. This allows for the application of specific staple patterns to suit varying construction conditions.

The other types of wheels employed by the present invention are a plurality of flattening wheels 38. The flattening wheels 38 are mounted to the cross member 36 in the same general location as the staple guns 30. In fact, the flattening wheel frames 40 are also employed as the mounting apparatus for the staple guns 30 themselves. The upper end of the flattening wheel frames 40 are attached to the cross member 36 in such a manner so that their lateral position along the cross member 36 may be altered. This feature of the present invention allows the lateral positioning of the staple guns 30 to be adjusted depending on the needs of a specific job.

The flattening wheels 38 have two purposes in the operation of the present invention. The first of these is to support its weight during operations. The position of the flattening wheels 38 is towards the front of the present invention and effectively on either of its outside edges. This not only provides support for the present invention, but also provides a lateral stabilizing effect due to the wide spacing of the flattening wheels 38. The second purpose of the flattening wheels 38 is to prepare the erosion control and stabilization blankets 98 for the stapling process. The actual mechanisms employed for this purpose will be discussed in greater detail below with reference to an additional FIGURE.

It must also be noted that an additional embodiment (not shown) of the present invention has been contemplated in which the odometer wheel 32 has been eliminated and its functions are carried out by the flattening wheels 38. In this configuration the sensing devices that were connected to the odometer wheel 32 are simply placed on one of the flattening wheels 38. However, in all other aspects of its operation, this embodiment of the present invention operates as described for the previous one. The advantage of this configuration is that it simplifies both construction and operation thereby lowering the costs of the present invention.

The overall configuration of the present invention and the staple guns 30 are further detailed in FIGS. 7, 8, and 9.

Specifically, these FIGURES illustrate the manner employed by the present invention to supply the staple guns 30 the power they need to operate and the methods used to control the application of that power. As previously stated, the auxiliary air compressor unit 14 supplies the necessary air pressure to operate the present invention and which is supplied to the control box 42 through the air feed line 54. The air feed line 54 is connected to the control box 42 by the use of air feed line coupler 68 which allows for the separation of the air feed line 54 in a quick and effective manner.

From the control box 42, the compressed air is diverted to the staple guns 30 through the primary air lines 44. The primary air lines 44 provide the air pressure to the staple guns 30 to drive the staples 104 into the ground 46. The control over this operation is supplied through the smaller secondary air lines 58. The secondary air lines 58 supply the small amount of air pressure to the staple guns 30 to activate and deactivate its firing mechanism.

These FIGURES also detail the manner of construction of the staple guns 30. The staple guns 30 are mounted to the present invention by means of the adjustable staple gun mount 60. The adjustable staple gun-mount 60 is attached to the rear portion of the flattening wheel frame 40 through the slot plate 61. The slot plate 61 contains a centrally positioned mount slot 62 to which the staple gun mount is slidably attached by means of a bolt 64. Finally, the staple guns 30 are attached to the adjustable staple gun mounts 60 though the staple gun frames 66. This method of securing the staple guns 30 to the present invention allows them to be adjusted in the vertical plane providing yet another mechanism by which it can be altered to fit job specific conditions.

The primary air lines 44 connect to the staple guns 30 through the primary feed line couplers 70. The primary feed line couplers 70 allow the staple guns 30 to be disconnected from their air source in the event that there is a requirement for service or repairs. The staple guns 30 are equipped with staple magazines 52 which perform two functions. The first of these is to store a large number of staples 104 providing for long periods of uninterrupted operation of the present invention. Additionally, the staple magazines 52 are designed to feed the stored staples 104 to the staple applicator 72 as they are needed.

The staple guns 30 are also equipped with staple guards 50. The staple guards 50 are constructed from spring steel (or other suitable material) sheets that are fixedly attached at their upper ends to the lower surface of the staple gun frames 66 and which bend backwards so that they engage the ground 46 at the staple applicator 72 as the present invention travels over it. The staple guards 50 operate in conjunction with the flattening wheels 38 to prepare the erosion control or stabilization blanket 98 for the proper insertion of the staple 104.

Figure 4:
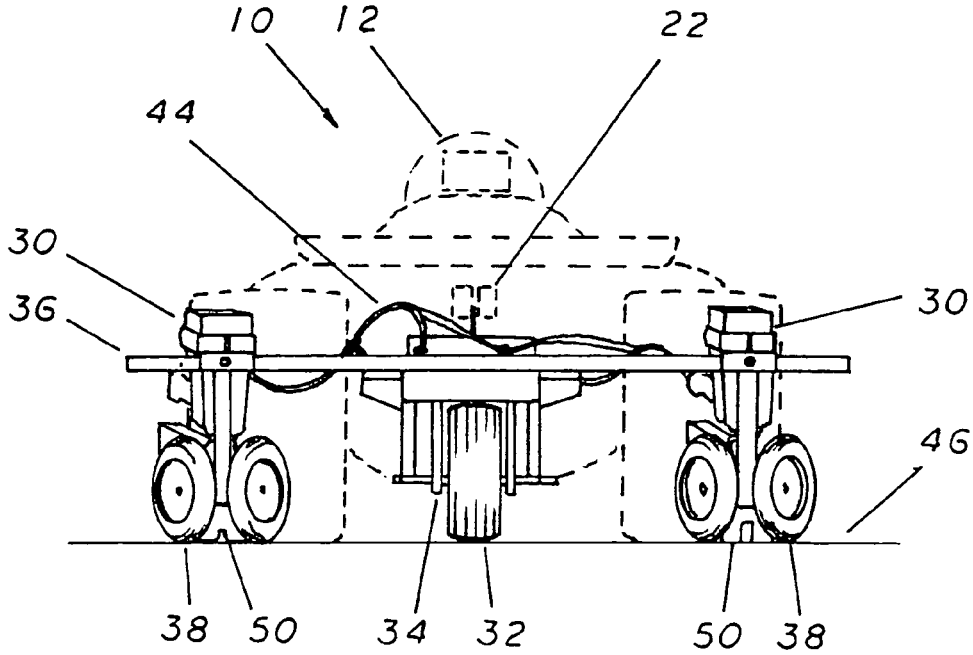
FIG. 4 is a front elevation view of the present invention illustrating the position of its major components relative to the surface of the ground when it is fully deployed.
Figure 5:
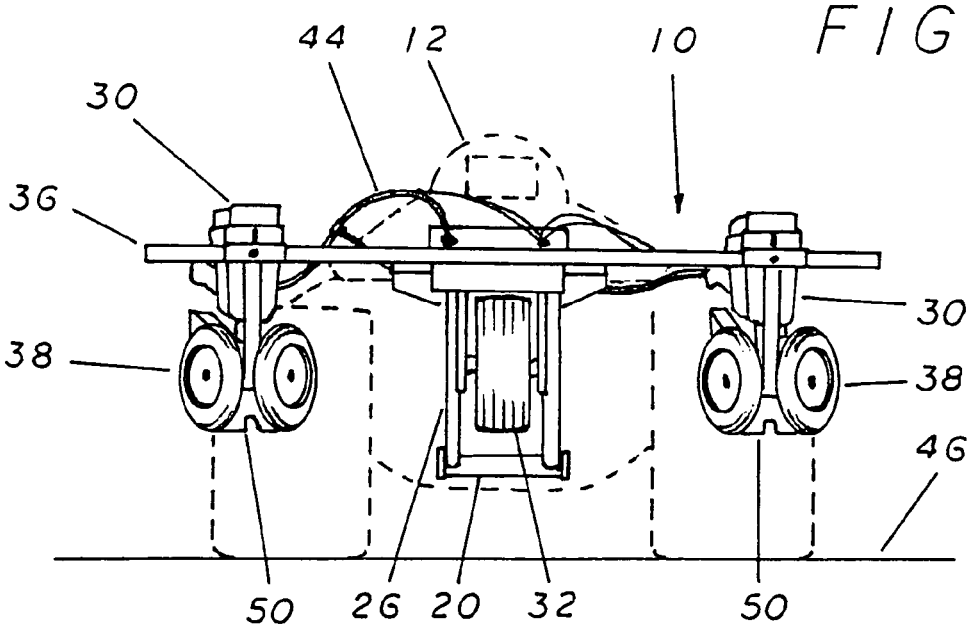
FIG. 5 is a front elevation view of the present invention of FIG. 4 illustrating its ability to articulate in a vertical manner with respect to the surface of the ground.

The pivotal nature of the apparatus mount 20 and its manner of operation with respect to the present invention and the vehicle 12 are further detailed in FIGS. 4, 5, and 6. As previously stated, the apparatus-mount 20 allows the present invention to be articulated with respect to the vehicle 12 in a vertical manner. This vertical articulation is accomplished by the use of the winch 22 and the winch cable 24 which extends from the winch 22 to the frame 26 of the invention. With this method of construction, the operation of the winch 22 may be used to lift the front end of the present invention off of the ground 46. This feature is primarily useful during transport or storage of the invention and vehicle 12, but can also be useful in certain circumstances in allowing for the angle formed between the present invention and the vehicle 12 to vary and adjust to uneven terrain.

The rotational aspect of the present invention serves a similar adjustment purpose. The cross member pivot 37 serves to pivotally attach the cross member 36 to the frame 26. The pivotal nature of this attachment is passive in nature thereby allowing the cross member 36 and the attached staple guns 30 to rotate in both a clockwise and counterclockwise manner. This provides the present invention with the capability of adjusting to side hill variations at job sites.

The manner of construction of the control box 42 and its related components is further illustrated in FIG. 10. The control box 42 is the component of the present invention that controls the distribution of the compressed air used to power and control the staple guns 30. From the air feed line 54 and air feed line coupler 68, the compressed air enters the manifold 74 located in the interior of the control box 42. A portion of the air flow is diverted from the manifold 74 to an air gauge 76 allowing the operator to monitor the pressure in the system.

The remaining air is channeled from the manifold 74 in one of two ways. The first of these is directly to the primary air lines 44 which feed the staple guns 30. The second portion of the air goes into the solenoid supply line 80 and then to an air T 82. The air T 82 then splits the air flow again to either the first solenoid 78 or to the air transfer line 84. The air transfer line 84 then directs the remaining air flow to the other solenoid 78. Each of the solenoids 78 is electrically connected to the system control panel 18 through the power feed 28. Additionally, each of the solenoids 78 are also connected to a pair of secondary air lines 58 which control the firing operations of the staple guns 30. The secondary air lines 58 leave the control box and are fed to the trigger mechanism of the staple guns 30 for this purpose.

The configuration of the system control panel 18 is further illustrated in FIG. 11. As previously stated, the system control panel 18 is the component of the present invention used to control its operations. In this, it is equipped with a plurality of control switches and lights. The first of these is the power on indicator light 86 which is tied to the main power switch 88 which in turn controls the power to the present invention. The system control panel 18 also contains the left and right stapler on/off switches, 90 and 92, that is tied to the solenoids 78 and controls the firing mechanisms of the staple guns 30.

The system control panel 18 also contains the manual and automatic operation buttons, 94 and 96. The manual operation button 94 allows the operator of the present invention to manually control the firing of the staple guns 30 in situations where it is necessary. The automatic operation button 96 fires the staple guns 30 at a predetermined interval depending upon the movement of the odometer wheel 32 while the vehicle 12 and present invention are moving forward. However, the automatic operation button 96 must be activated on a consistent basis during the operation or the system will revert to the manual mode. This is a safety feature that ensures that the staple guns 30 will not continue to fire when it is not necessary.

The operation of the flattening wheels 38 is further illustrated in FIG. 12. As stated previously, the flattening wheels 38 operate to remove wrinkles 100 and other irregularities from the surface of the erosion control or stabilization blanket 98 prior to the insertion of the staple 104. This operation is due to the opposing diagonal orientation of the pair of flattening wheels 38 that are positioned forward of the staple guard 50 and the point of staple 104 insertion. The passage of the flattening wheels 38 serves to stretch the erosion control or stabilization blanket 98 between them, thereby removing any wrinkles 100. This results in a flattened area 102 behind the flattening wheels 38 and which is further held in place by the staple guard 50. These processes prepare the erosion control or stabilization blanket 98 for the insertion of the plurality of staples 104. Finally, FIG. 13 illustrates how the staples 104 penetrate the erosion control or stabilization blanket 98 and the ground 46 to secure them in the desired position.

Figure 14:
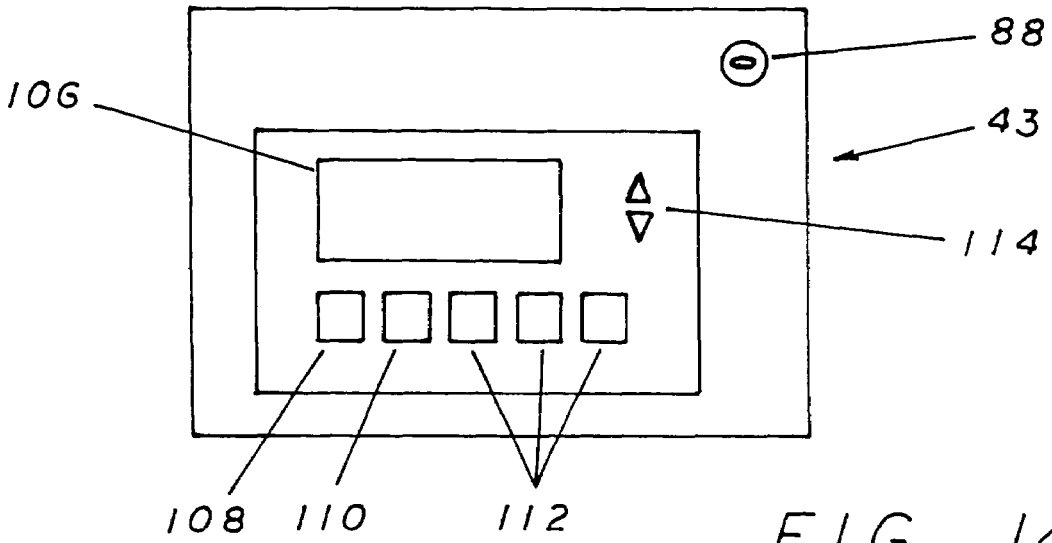
FIG. 14 is a front elevation view of an optional component of the present invention illustrating its manner of construction and the orientation of its components.

FIG. 14 illustrates an alternative embodiment of the system control panel 18 component of the present invention, the electronic system control module 43. The electronic system control module 43 provides the present invention with a greater degree of flexibility in the manner employed to secure the erosion control or stabilization blanket 98 to the desired surface.

The electronic system control module 43 contains a digital display panel 106 which displays the current status of the present invention's systems and allows for the selection of a number of different menu options. The control of the display panel 106 is accomplished through a plurality of switches. The first of these is the manual operation switch 108 that allows for the manual selection of differing operational systems. The second is the automatic operation switch 110 that allows for the selection of automated control systems. The electronic system control panel 43 is also equipped with a plurality of pre-program switches 112 that allow for the selection of pre-programmed staple patterns that can be tailored to fit specific stapling needs. Additionally, the display panel 106 contains a menu switch 114 that allows the user to access the electronic system control module's 43 other operational features. The electronic system control module 43 is also equipped with a main power switch 88 that turns it on and off.

Finally, when the electronic system control module 43 is employed with the present invention a separate manual operation button (not shown) is fitted to the steering mechanism 16 of the vehicle 12. The use of this button allows for the manual firing of the staple guns 30 and to hold and automatically fire depending on the selected function of the electronic system control module 43.

Figure 15:
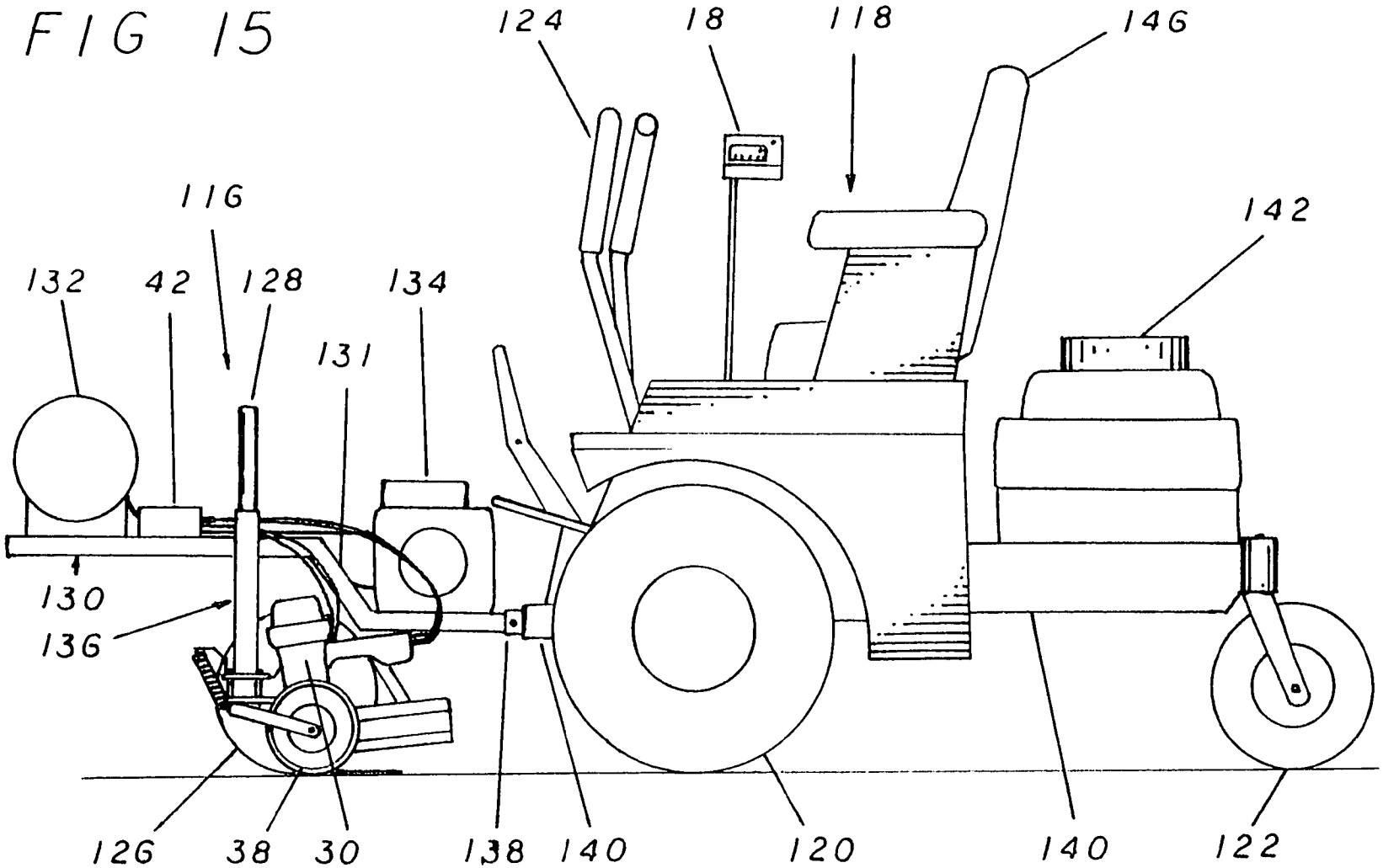
FIG. 15 is a side elevation view of an alternative embodiment of the present invention illustrating a zero turn radius riding lawn mower as equipped with a specifically designed embodiment of the present invention.
Figure 16:
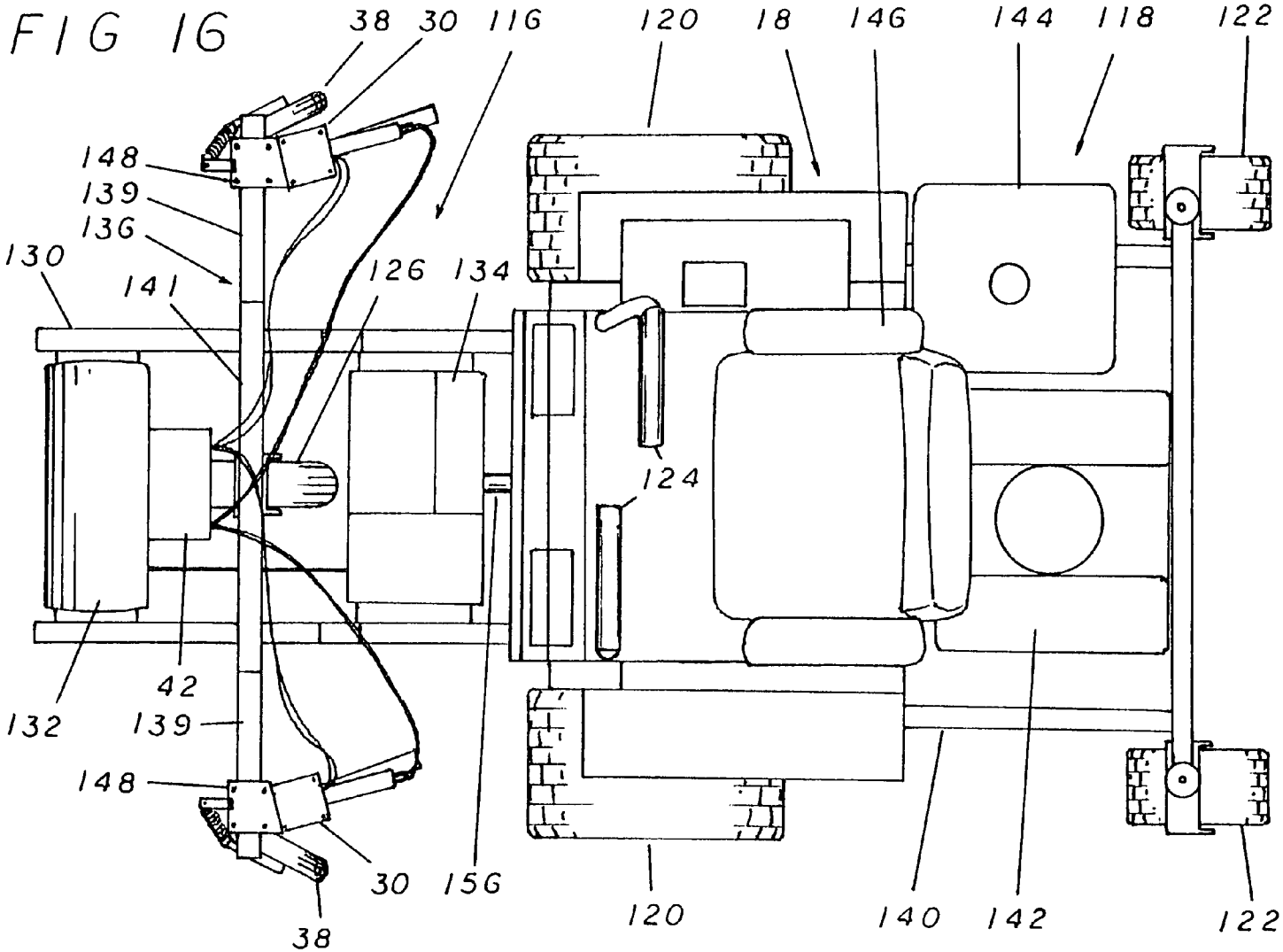
FIG. 16 is a top elevation view of the alternative embodiment of the present invention of FIG. 15.
Figure 23:
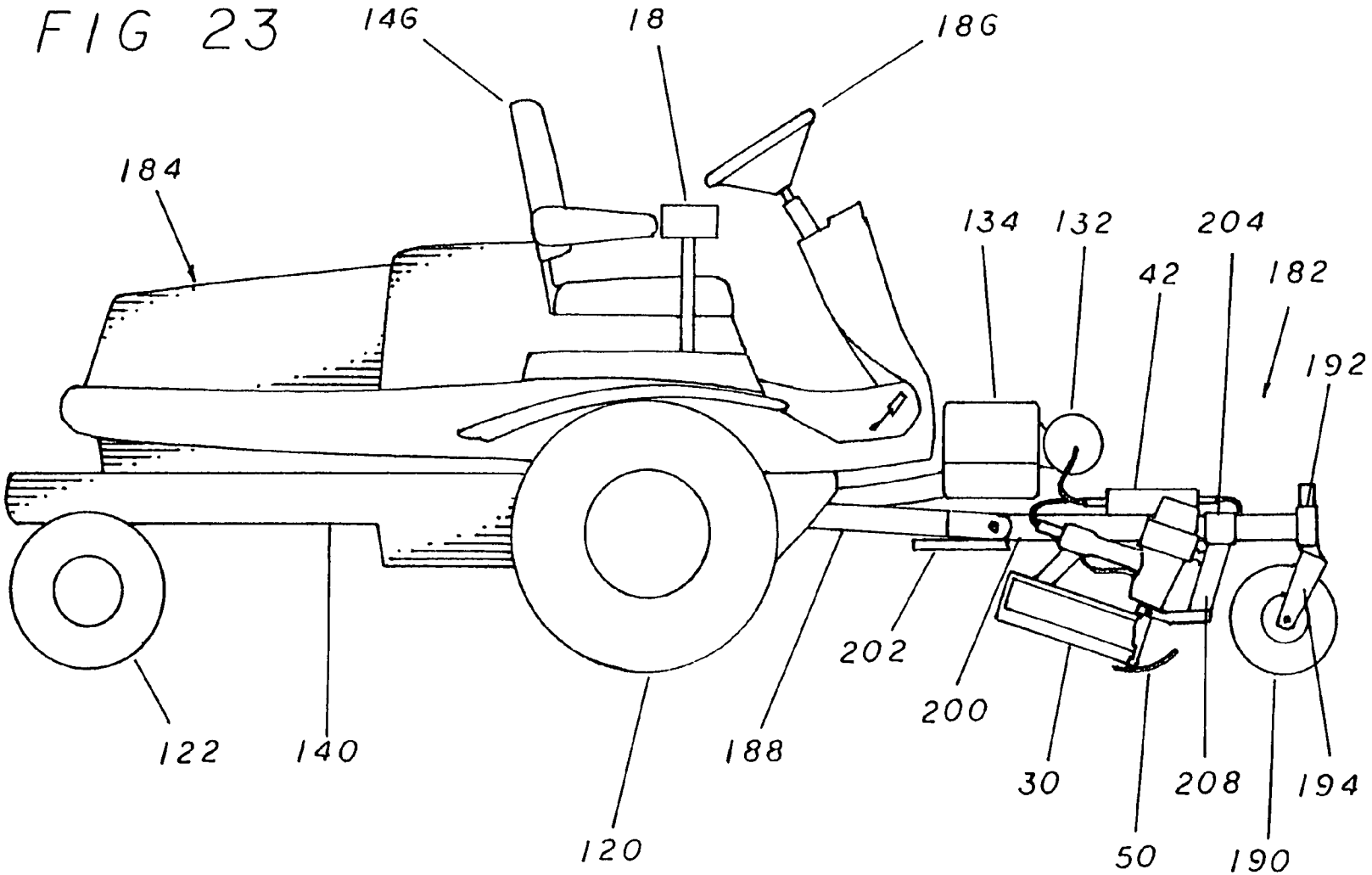
FIG. 23 is a side elevation view of a still further alternative embodiment of the present invention illustrating an additional style of a zero turn radius riding lawn mower that is using an independently articulating erosion control stapler apparatus.

A further embodiment of the present invention has been contemplated in which a mower mounted erosion control stapler apparatus 116 is constructed in a manner that allows for its use with a commonly used riding zero turn radius riding mowers 118. This embodiment is illustrated in FIGS. 15 and 16. As opposed to tractor style riding mowers or the all terrain vehicle illustrated in the previous embodiment, these riding zero turn radius mowers 118 are constructed with a frame that is relatively low to the ground. As a result of this, the frame of this embodiment of the present invention must be designed to accommodate this low frame while providing a means for both its support and for the placement of the staplers in the necessary position.

The riding zero turn radius riding mowers 118 generally consist of a pair of relatively large front drive wheels 120 located at its most forward end. Conversely, the rear of the unit is generally equipped with a pair of rear castor wheels 122. This configuration is critical to the operation of the riding zero turn radius riding mowers 118 as not only the drive operations are provided by the front drive wheels 120, but they also control its steering operations as well. The use of the rear castor wheels 122 allows the rear of the vehicle to follow the directional impetus of the front drive wheels 120 thereby facilitating the desirable zero turn radius feature of these types of mowers.

The driver's position on the riding zero turn radius riding mowers 118 is perfect for the operation of this embodiment of the present invention. The mower seat 146 is positioned high over the front drive wheels 120 just forward of the mower's engine 142 and gas tank 144 that are in turn mounted between the rear portion of the mower frame 140. This places the operator in a position that gives a very good view of the operation of the present invention and the terrain over which it is traveling.

From the elevated position on the mower seat 146, the operator controls the riding zero turn radius riding mower 118 by the use of the mower control arms 124. The mower control arms operate in the same manner as a skid steer as they do not affect the directional attitude of the front drive wheels 120, but rather the amount of power that is applied to each one. In this drive and steering system, power applied equally to each of the front drive wheels 120 will result in straight travel while varying amounts to either side results in turns in the direction of the lesser powered front drive wheel 120. As in the previous embodiment of the present invention, control over its operational aspects is facilitated by the use of the system control panel 18 that is mounted in such a way so that it is within easy reach of the operator's position in the mower seat 146.

This embodiment of the present invention employs two parallel rails 137 to form the apparatus step up frame 130. The apparatus step up frame 130 is the backbone of this embodiment of the present invention upon which all of its other components are mounted. The parallel rails 137 are pivotally attached to the most forward ends of the mower frame 140 by the use of a pair of mower frame pivot brackets 138. This method of attaching this embodiment of the present invention to a riding zero turn radius riding mower 118 allows it to pivot in the vertical plane, the purpose of which will be described in greater detail below.

The parallel rails 137 of the apparatus step up frame 130 extend forward in a horizontal (with reference to their neutral position and riding zero turn radius riding mower 118) manner. This initial horizontal portion provides for the placement of an air compressor 134. The air compressor 134 is typically powered by a power take off (PTO) 158 located on the most forward end of the riding zero turn radius riding mower 118, however, a self-contained unit would work in this application equally as well. The PTO 158 is a powered shaft that is employed on many vehicles to power supplemental equipment that can be attached to and operated from such vehicles.

Just forward of the position of the air compressor 134, the parallel rails 137 of the apparatus step up frame 130 angle upward in a diagonal manner for a short distance to form the diagonal frame 131. At the end of this diagonal frame 131, the parallel rails 137 then again return to their horizontal orientation and extend forward to their terminus. This horizontal section of the parallel rails 137 provides a plurality of purposes in relation to the operation of this embodiment of the present invention. The first of these is to allow for the attachment of the air tank 132. The air tank 132 stores a volume of compressed air for use in the staplers 30. The air tank 132 is typically positioned on the most forward ends of the parallel rails 137. Additionally, this horizontal portion of the parallel rails 137 also allows for the attachment of the control box 42 which distributes the compressed air as needed by the individual components during the operation of this embodiment of the present invention.

Most importantly, this horizontal section of the parallel rails 137 of the apparatus step up frame 130 allow for the elevated—in relation to the frame of the riding zero turn radius riding mower 118—attachment of the drop-down stapler frame 136. The drop-down stapler frame 136 is attached to the parallel rails 137 in a perpendicular manner just forward of the diagonal frame 131 section. Additionally, the drop-down stapler frame 136 is configured with a central U-shaped frame 141. The inner portion of this central U-shape frame 141 provides the point of attachment for the drop-down stapler frame 136 to the parallel rails 137. Additionally, the outer ends of the drop-down stapler frame 136 return to a horizontal orientation forming the outer horizontal frames 139. These outer horizontal frame 139 sections then provide for the attachment of the staplers 30 in positions so that they may easily engage the surface over which the present invention is traveling.

An additional unique feature of this embodiment of the present invention is the centrally positioned apparatus support wheel 126. The apparatus support wheel 126 is attached to the central portion of the drop-down stapler frame 136 by means of the support wheel pin 128 that extends through the central U-shaped frame 141. The apparatus support wheel 126 is of the castor design allowing it to easily track with the direction of the riding zero turn radius riding mower 118 while providing the necessary support to this embodiment of the present invention. Additionally, when operating in conjunction with the pivotal attachment of the parallel rails 137 of the drop-down stapler frame 136 by the use of the mower frame pivot brackets 138, the apparatus support wheel 126 allows the staplers 30 to follow the contours of hills and depressions while supporting the drop-down stapler frame 136, thereby providing a means by which this embodiment of the present invention can be effectively employed on uneven terrain. The manners of operation of these mechanisms are further illustrated in FIGS. 17 and 18.

The manner by which the staplers 30 are attached to the drop-down stapler frame 136 is illustrated in FIGS. 19 and 20. This attachment is accomplished through the use of the drop-down stapler mount 148. The drop-down stapler mount 148 secures this attachment by the use of two members that are fixed to the outer horizontal frames 139 by the use of a plurality of bolts 64. This design of the drop-down stapler mounts 148 allows the placement of the staplers 30 along the length of the outer horizontal frames 139 to be varied thereby providing a means by which conditions requiring stapling patterns of differing widths may be easily accommodated.

These FIGURES also illustrate the unique design of the flattening wheels 38 employed with this embodiment of the present invention. While the previous embodiment used two flattening wheels 38 on each stapler 30, this embodiment employs only one on each of the two staplers 30. The important thing to note about this configuration of the flattening wheels 38 is their orientation with respect to each other and to the apparatus step up frame 130. This orientation is such so that the leading portion of each of the flattening wheels 38 is pointed towards the center line of the apparatus step up frame 130. Therefore, as the flattening wheels 38 travel, they operate in the same manner as described above for the flattening wheels used in the previous embodiment only over a wider area.

Finally, with respect to this embodiment of the present invention, the method employed to attach the flattening wheels 38 to the drop-down stapler frame 136 is also unique. This is a pivotal attachment that is accomplished by the use of a flattening wheel arm 150 that secures the flattening wheel 38 at its distal end and that is pivotally attached to the outer horizontal frame 139 through the wheel arm axle cylinder 160 near its proximal end.

Additionally, the attachment of the flattening wheel arm 150 is augmented by the use of the wheel arm spring 152. The upper end of the wheel arm spring 152 is attached to the upper end of a spring bracket 154 which is in turn fixed to the upper side of the drop-down stapler mount 148. The lower end of the wheel arm spring 152 is attached to the proximal end of the flattening wheel arm 150. Thus, the use of the wheel arm spring 152 operates to place a downward force on the flattening wheel 38 through the flattening wheel arm 150. This configuration creates a suspension element in the attachment of the flattening wheels 38 allowing them to accommodate small irregularities in the ground without affecting the operation of the staplers 30. In all other aspects of its operation, this embodiment of the present invention functions in the same manner as described above for the previous embodiment.

A yet further embodiment of the present invention has been contemplated in which the pneumatically operated staplers 30 are replaced by hydraulic staplers 164. The resulting hydraulic stapler apparatus 162 is illustrated in FIGS. 21 and 22 and varies only from the previously described embodiment of the present invention in the use of the hydraulic staplers 164. As a result, any of these embodiments are capable of being adapted to use the hydraulic staplers 164, however, for the sake of simplicity the provided FIGURES illustrate their use only in conjunction with the latter embodiment.

This embodiment of the present invention requires a number of modifications relative to the previous embodiments. The first of these is the use of the hydraulic staplers 164. The hydraulic staplers 164 operate and attach in the same manner as the pneumatic staplers 30 except that they employ hydraulic cylinders 178 to fire the staples. The hydraulic pressure that is necessary for their operation is supplied through the use of a hydraulic pump 166 that is mounted on the rearward portion of the parallel rails 137 of the apparatus step up frame 130. In the illustrated case, the hydraulic pump 166 is powered by a PTO drive shaft 156 that is connected to the mower's PTO 158, but a stand-alone unit would work equally as well.

The hydraulic pump 166 is supplied with hydraulic fluid by the fluid reservoir 168 through the pump feed line 176. The fluid reservoir 168 is positioned at the front of the apparatus step up frame 130. The hydraulic fluid is directed to and from the hydraulic staplers 164 through the hydraulic pressure control valve 180 by means of the primary hydraulic pressure line 170. The hydraulic pressure control valve 180 then directs the flow of hydraulic pressure to and from the hydraulic staplers 164 through the stapler pressure and returns lines, 172 and 174. In all other aspects of its operation, this embodiment of the present invention functions in the same manner as described above for the previous embodiments.

Figure 24:
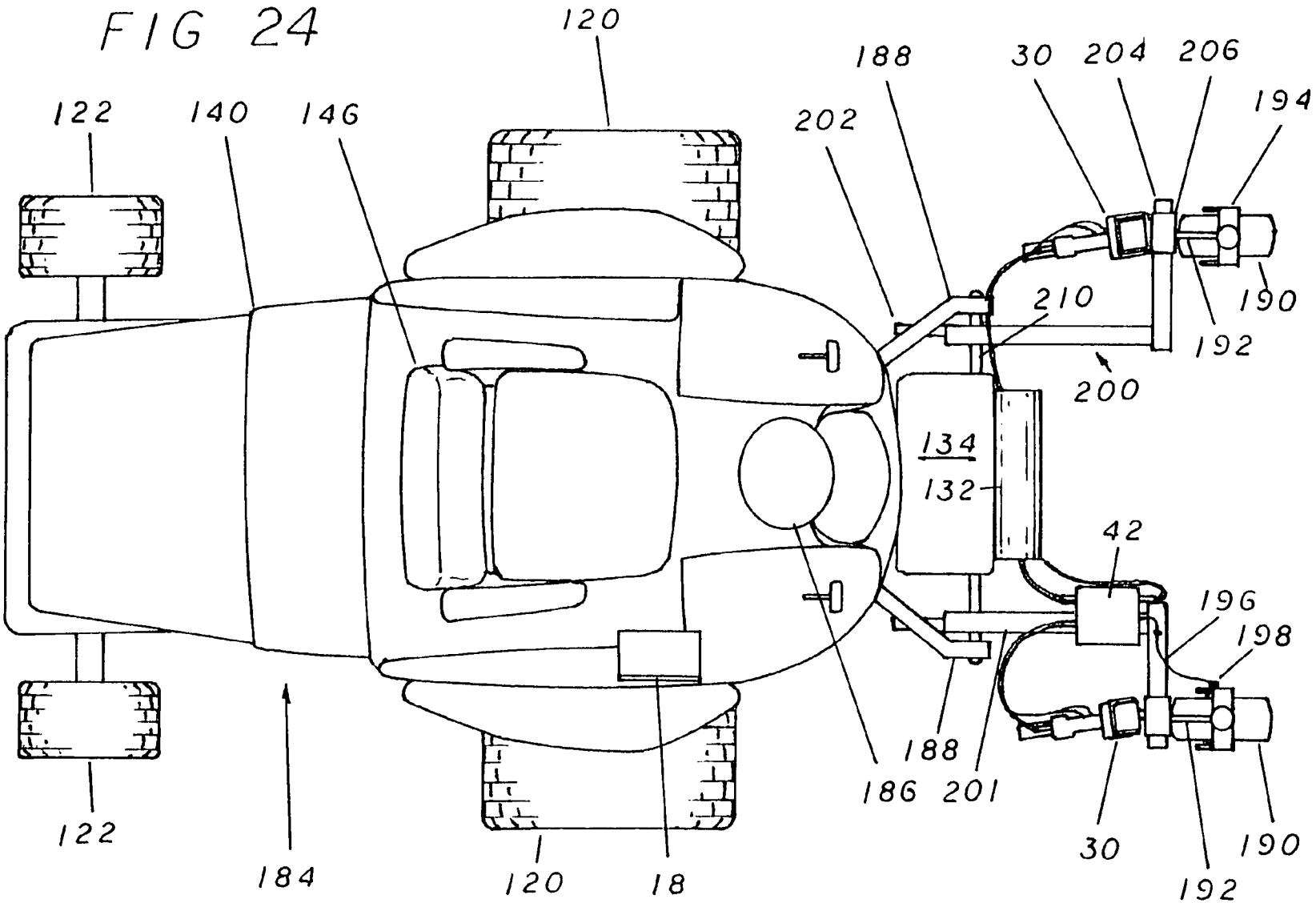
FIG. 24 is a top elevation view of the still further embodiment of the present invention of FIG. 23.

Finally, a still further embodiment of the present invention has been contemplated in which the frames of the previous embodiments are replaced with a frame that is made up of two independent pivot frames 200 the general construction of which is illustrated in FIGS. 24 and 25. The resulting embodiment is referred to as the independently articulating erosion control stapler apparatus 182. This embodiment of the present invention in designed and constructed with different features that perform the same function as their analogs in the previous embodiments of the present invention.

This embodiment of the present invention is illustrated in these FIGURES as used with a specific type of front drive mower 184. This type of mower is also a zero radius turn mower but differs in the methods employed to control its direction of travel. As with the previous embodiment, this style of front drive mower 184 is equipped with a pair of relatively large front drive wheels 120 and correspondingly small rear castor wheels 122. These wheels then support a mower frame 140 which in turn provides support for the remaining components of the front drive mower 184.

One prominent difference in the mower employed with this embodiment of the present invention is its use of a standard steering wheel 186 to control the direction of travel of the front drive mower 184 and which is positioned just forward of the centrally located mower seat 146. The advantage of this steering system is its familiarity to the average person as opposed to the skid steer systems used in similar mowers.

This opens it for use with a greater percentage of the population thereby providing the same benefits for the operation of this embodiment of the present invention.

The primary benefit offered by the use of this style of front drive mower 184 lies in the method employed to suspend and control the mower deck off of the front of the vehicle. These functions are accomplished by the use of a pair of mower accessory mount arms 188 that extend outward from the most forward end of the front drive mower 184. Additionally, these mower accessory mount arms 188 may be lowered or raised by the operator as needed. This capability allows the operator of the front drive mower 184 to raise or lower this embodiment of the present invention when necessary to engage or disengage it from the surface of the ground.

In general, this embodiment of the present invention positions each of two staplers 30 on two independent pivot frames 200 that are each pivotally attached to the distal ends of the mower accessory mount arms 188. The manner of attachment accomplishes a plurality of purposes with respect to the operation of this embodiment of the present invention. One of these is to allow for its positioning at the front of the front drive mower 184 so that its operation may be constantly monitored by the operator. As previously stated, the mower accessory mount arm's 188 ability to be raised and lowered allows the operator to raise this embodiment of the present invention off of the ground when not in use or when it is necessary to move it from on place to another. Finally, its positioning at the front end of the front drive mower functions in conjunction with the design of these style of mowers.

The pivotal attachment of the two independent pivot frames 200 to the mower accessory mount arms 188 is accomplished by the use of the frame pivot bar 210, the position and operation of which is also detailed in FIGS. 26 and 27. The frame pivot bar 210 spans the area between the distal end of the mower accessory mount arms 188. This provides for the pivotal points of attachment of the proximal ends of the independent pivot frames 200 just inside the corresponding mower accessory mount arms 188. This method of attachment allows each of the independent pivot frames 200 to rotate in a vertical plane around this point of attachment. This capability is central to the operation of this embodiment of the present invention in that it allows each of them to adjust to irregularities in the ground surface independently from each other. This design enhances the operation of the present invention especially in uneven terrain as it provides a method that ensures that each applied staple will have the maximum possible contact with the ground to which it is applied.

The independent pivot frames 200 are made up of two primary components. The first of these is the pivot member 201 that makes the necessary pivotal connection and forms the base of this embodiment of the present invention to which the rest of the components are attached. Near their point of pivotal attachment at their proximal ends, the pivot members 201 are also equipped with the frame pivot stops 202, the construction and operation of which are also detailed in FIGS. 26 and 27. The frame pivot stops 202 are fixedly attached to the lower surface of each pivot member 201 and extend beyond their proximal ends. The function of the frame pivot stops 202 is to limit the downward travel of the independent pivot frames 200 by engaging the lower surfaces of the mower accessory mount arms 188 in the desired location. This is typically the point where the horizontally oriented line formed by the configuration of the mower accessory mount arms 188 is extended by the line formed by the independent pivot frames 200. That is to say, the downward limit of the vertical travel of the independent pivot frames 200 is the horizontal plane defined by the mower accessory mount arms 188. In this configuration, the independent pivot frames are free to move upward to compensate for varying terrain, but the use of the frame pivot stops 202 fixes their amount of downward travel thereby allowing for their manipulation with respect to the ground as described above.

The second component of the independent pivot frames 200 is the stapler frame 204. The stapler frame 204 is fixedly attached to the distal end of the pivot members 201 in a perpendicular manner. Additionally, this attachment is accomplished so that the majority of the stapler frames 204 extend outward with respect to the center line of this embodiment of the present invention. This configuration ensures that the two staplers 30 can be located in the optimal position with respect to each other to meet the requirements of the job at hand.

The manner in which the two independent pivot frames 200 are capable of independently articulating around their pivotal connection to the mower accessory mount arms 188 is further detailed in FIG. 25. This FIGURE clearly illustrates the independent pivot frame 200 in the foreground in an elevated orientation with respect to the one in the background. This independent articulating ability allows the attached staplers 30 to more closely follow the contour of the ground over which the invention is traveling.

FIG. 25, as well as the preceding two, also illustrates the position and manner of construction of the front support castor wheels 190. The staplers 30 are attached to the stapler frames 204 by the use of stapler mount collars 206 (to be described in greater detail below) also provide for the point of attachment for the castor wheel frames 192. The castor wheel frames 192 extend forward from the most forward surface of the stapler mount collar 206 and serve to allow for the attachment of the front support castor wheels 190.

The front support castor wheels 190 support the forward end of this embodiment of the present invention and are mounted within castor wheel brackets 194 that allow them to pivot around their vertical axis attachment to the castor wheel frames 192. The front support castor wheels 190 replace the flattening wheels 38 of the previous embodiments but it must be noted that the flattening wheels 38 of the previous embodiments could also replace the front support castor wheels 190 employed in this embodiment of the present invention.

Additionally, one of the front support castor wheels 190 can also be constructed to perform the odometer operations that are used in the previous embodiment of the present invention. The electrical connection required by this is accomplished by an odometer wire 196 that runs from the applicable front support castor wheel 190 to the control box 42 located on the relevant pivot member 201. The nature of front support castor wheels 190 requires that this odometer wire 196 be fitted with an odometer wire swivel connector 198 ensuring that the odometer wire 196 will not become tangled no matter how many times the front support castor wheel 190 spins around its vertical axis during the operation of the present invention.

As previously stated, the attachment of the staplers 30 to the stapler frames 204 is accomplished by the use of the stapler mount collars 206. This attachment is illustrated in FIGS. 28 and 29. The stapler mount collars 206 are made of relatively short sections of square tubing having an internal dimension that is large enough to fit over the stapler frames 204. The stapler mount collars 206 can then be slipped over the stapler frames 204 to form the desired attachment. Additionally, once the proper position of the stapler mount collar 206 and the attached stapler relative to the stapler frame 204 has been obtained, the entire assembly is held in place by the use of the collar lock bolt 212. The collar lock bolt 212 is simply a threaded bolt that passes through the body of the stapler mount collar 206 and is used to engage the outer surface of the stapler frame 204. This then serves to lock the stapler mount collar 206 in the desired location. The important point in this system is that it allows the position of the staplers to be varied with respect to the length of the stapler frames to conform with a variety of possible requirements.

The attachment of the staplers 30 to the stapler mount collars 206 is facilitated by the use of the stapler mount bars 208. The stapler mount bars 208 are fixedly attached to the lower surfaces of the stapler mount collars 206 and extend downward therefrom. The staplers 30 are then attached to this at their upper ends by the upper stapler connection 218 and at their lower end by the lower stapler mount brackets 220. These components serve to position the staplers 30 in the desired location so that the stapler guard 50 can engage the ground in the desired manner so that the staple may be dispensed at the forward end of the staple magazine 52. Thus, the components of this embodiment of the present invention are positioned to perform the function that is central to the operation of the present invention.

Finally, it must also be noted that this embodiment of the present invention provides for the positioning of an auxiliary air compressor 134 and air tank 132. As illustrated, the air compressor 134 employed can be a stand-alone unit powered by a separate gasoline engine. Additionally, it could also consist of an air compressor 134 that is powered by a connection to the front drive mower 184 through a PTO. Finally, the power source for this embodiment of the present invention could also be comprised of a hydraulic system as described for the previous embodiment of the present invention.

Although the present invention has been described in considerable detail with reference to certain preferred versions thereof, other versions are possible. Therefore, the spirit and scope of the appended claims should not be limited to the description of the preferred versions contained herein.

What is claimed:

1. A vehicle mounted stapling apparatus for use in stapling erosion control, landscaping and stabilization fabric to the ground said vehicle mounted stapling apparatus comprising:

an elongate frame having a first and a second end, said first end of said elongate frame having an apparatus mount for pivotally mounting said elongate frame to said vehicle;

a cross member mounted to said second end of said elongate frame said cross member being perpendicular to said elongate frame;

a stapler mounted to said cross member; and a cross member pivot mount mounted between said second end of said elongate frame and said cross member so as to allow said cross member to pivot relative to said elongate frame.

2. A vehicle mounted stapling apparatus as in claim 1 further comprising a compressed air source connected to said stapler.

3. A vehicle mounted stapling apparatus as in claim 1 further comprising a first and second stapler wheel attached to said cross member in front of said stapler.

4. A vehicle mounted stapling apparatus as in claim 3 wherein said first and second stapler wheels are mounted in a V formation with the opening of said V formation opening toward said stapler and the point of said V formation pointing forward in front of said stapler.

5. A vehicle mounted stapling apparatus as in claim 1 further comprising an odometer wheel mounted to said cross member.

6. A vehicle mounted stapling apparatus as in claim 1 further comprising a control mechanism for controlling the firing of said stapler.

7. A vehicle mounted stapling apparatus as in claim 1 further comprising multiple staplers and stapler wheels mounted to said cross member.

8. A mobile stapling apparatus for use in stapling erosion control, landscaping and stabilization fabric to the ground said mobile stapling apparatus comprising:

an all terrain vehicle;

an elongate frame having a first and a second end, said first end of said elongate frame being pivotally mounted to said all terrain vehicle;

a cross member mounted to said second end of said elongate frame said cross member being perpendicular to said elongate frame;

a stapler mounted to said cross member;

a first and second stapler wheel attached to said cross member in front of said stapler wherein said first and second stapler wheels are mounted in a V formation with the opening of said V formation opening toward said stapler and the point of said V formation pointing forward in front of said stapler.

9. A mobile stapling apparatus as in claim 8 further comprising a winch mounted on said all terrain vehicle with a winch cable attached to said elongate frame for raising and lowering said elongate frame.

10. A mobile stapling apparatus as in claim 8 further comprising a cross member pivot mount mounted between said second end of said elongate frame and said cross member so as to allow said cross member to pivot relative to said elongate frame.

11. A mobile stapling apparatus as in claim 8 further comprising a compressed air source mounted to said all terrain vehicle, wherein said compressed air source being connected to said stapler for powering said stapler.

12. A mobile stapling apparatus as in claim 8 further comprising an odometer wheel mounted to said cross member.

13. A mobile stapling apparatus as in claim 12 further comprising a control mechanism for controlling the firing of said stapler, said control mechanism being attached to said odometer wheel for distance measuring.

14. A mobile stapling apparatus for use in stapling erosion control, landscaping and stabilization fabric to the ground said mobile stapling apparatus comprising:

a mower type vehicle;

an elongate frame having a first and a second end, said first end of said elongate frame being pivotally mounted to said mower type vehicle;

a cross member mounted to said second end of said elongate frame said cross member being perpendicular to said elongate frame and a cross member pivot mount mounted between said second end of said elongate frame and said cross member so as to allow said cross member to pivot relative to said elongate frame;

a first stapler and second stapler mounted to said cross member; and a first and second stapler wheel attached to said cross member in front of said first and second stapler wherein said first and second stapler wheels are mounted in a V formation with the opening of said V formation opening toward said stapler and the point of said V formation pointing forward in front of said stapler.

15. A mobile stapling apparatus as in claim 14 further comprising a means on said mower type vehicle for raising and lowering said elongate frame.

16. A mobile stapling apparatus as in claim 1 further comprising a compressed air source mounted to said mower type vehicle, wherein said compressed air source being connected to said first stapler and second stapler for powering said first stapler and said second stapler.

17. A mobile stapling apparatus as in claim 16 further comprising a control mechanism for controlling the firing of said stapler and said compressed air source, said control mechanism being attached to an odometer wheel on said cross member for distance measuring.

* * * * *